US007056206B2

(12) United States Patent
Aoki et al.

(10) Patent No.: US 7,056,206 B2
(45) Date of Patent: Jun. 6, 2006

(54) METHOD OF CONDUCTING A VIDEO POKER GAME

(76) Inventors: Dion K. Aoki, 2925 Wigwam Pkwy., #924, Henderson, NV (US) 89074; Benjamin T. Gomez, 5224 W. Belle Plaine, Chicago, IL (US) 60614; Cullen P. O'Day, 9628 Lightheart Ave., Las Vegas, NV (US) 89148; Alfred Thomas, 2385 E. Windmill #247, Las Vegas, NV (US) 89123

( * ) Notice: Subject to any disclaimer, the term of this patent is extended or adjusted under 35 U.S.C. 154(b) by 0 days.

(21) Appl. No.: 10/436,002

(22) Filed: May 12, 2003

(65) Prior Publication Data

US 2004/0229672 A1 Nov. 18, 2004

(51) Int. Cl.
*A63F 9/24* (2006.01)

(52) U.S. Cl. ..... 463/13

(58) Field of Classification Search ..... 463/13, 463/16, 19–22, 25, 30–31; 273/292, 139
See application file for complete search history.

(56) References Cited

U.S. PATENT DOCUMENTS

2002/0119813 A1* 8/2002 Colin et al. ..... 463/11
2003/0040352 A1* 2/2003 Marks et al. ..... 463/13
2003/0189290 A1* 10/2003 Moody ..... 273/292
2004/0212147 A1* 10/2004 Ward et al. ..... 273/138.1

* cited by examiner

*Primary Examiner*—Kim Nguyen
(74) *Attorney, Agent, or Firm*—Jenkens & Gilchrist

(57) ABSTRACT

A method of conducting a video poker game is disclosed. After a player makes a wager, a plurality of face-up cards are dealt from a deck into a card hand. If any of the face-up cards is a predefined special card, the game proceeds with a special feature that allows the player to draw a replacement card to replace the special card. The replacement card may be drawn from a plurality of possible face-up or face-down cards. The game may include a standard draw option that allows a player to select and replace none or more of the face-up cards. The special card may trigger the special feature at any time, whether it appears before or after the draw. The game determines a poker hand ranking of the final card hand and provides an award based on that ranking.

32 Claims, 25 Drawing Sheets

METHOD OF CONDUCTING A VIDEO POKER GAME

FIELD OF THE INVENTION

The present invention relates generally to video poker and, more particularly, to a video poker game that triggers a special game feature if any of the face-up cards is a predefined special card. The special feature allows the player to draw a replacement card to replace the special card.

BACKGROUND OF THE INVENTION

Video draw poker has been played in gaming establishments for many years. In conventional video draw poker, a single player does not play against a dealer or other players, but rather attempts to achieve a highest possible poker hand ranking. After a player makes an initial wager and is dealt five face-up cards from a standard 52-card deck, the player is allowed to discard and replace unwanted cards with replacement cards from the deck, resulting in a final card hand. The game then determines a poker hand ranking of the final card hand and provides an award based on a pay table. The pay table includes a list of winning poker hand rankings and the award for each ranking. The winning poker hand rankings for a standard Jacks or Better video poker game include in order from highest to lowest: Royal Flush, Straight Flush, Four of a Kind, Full House, Flush, Straight, Three of a Kind, Two Pair and a Pair of Jacks or Better. Any poker hand having a ranking less than a Pair of Jacks or Better is a losing hand.

Variations to conventional video draw poker have been developed. Some variations add one or more wild Jokers to the standard 52-card deck or consider certain cards (e.g., deuces, sevens, etc.) in the standard 52-card deck to be wild. Other variations modify the pay table to award premiums for certain poker hand rankings. These variations, however, still use the standard video draw poker methodology of dealing five cards, discarding the unwanted cards, and drawing replacement cards to replace the discarded cards. As casino patrons become bored with these nominal variations of conventional video draw poker, gaming establishments are continually looking for new video poker games that will attract frequent play and hence increase profitability to the gaming establishment.

SUMMARY OF THE INVENTION

A method of conducting a video poker game is disclosed. After a player makes a wager, a plurality of face-up cards are dealt from a deck into a card hand. If any of the face-up cards is a predefined special card, the game proceeds with a special feature that allows the player to draw a replacement card to replace the special card. In one embodiment, the replacement card is drawn from a plurality of possible face-down cards. In another embodiment, the replacement card is drawn from a plurality of possible face-up cards. The game may include a standard draw option that allows a player to select and replace none or more of the face-up cards. The special card may trigger the special feature at any time, whether it appears before or after the draw. The game determines a poker hand ranking of the final card hand and provides an award based on that ranking.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent upon reading the following detailed description and upon reference to the drawings.

FIG. 3 is an image of a main poker game screen prior to dealing a hand.

FIG. 4 is an image of a pay table.

FIG. 5 is an image of a main poker game screen after dealing a hand from a deck and after a player selects which cards to hold.

FIG. 6 is an image of a main poker game screen after the selected cards are held and the non-held cards are replaced with new cards drawn from the deck, resulting in a winning poker hand ranking (e.g., 3 of a Kind).

FIG. 7 is an image of the pay table with the winning poker hand ranking highlighted.

FIG. 8 is an image of a main poker game screen after dealing a hand from the deck, wherein one of the dealt cards is a predefined special card (e.g., "Go Fish!" card) that triggers a special feature (e.g., "Go Fish!" feature).

FIG. 9 is an image of a main poker game screen after a player selects one of seven additional cards behind the special card to replace the special card (e.g., by tapping a "Go Fish!" button) and then selects which cards in the hand to hold.

FIG. 10 is an image of a main poker game screen after the selected cards are held and the non-held cards are replaced with new cards drawn from the deck, resulting in a winning poker hand ranking (e.g., Jacks or Better).

FIG. 11 is an image of the pay table with the winning poker hand ranking highlighted.

FIG. 12 is an image of a main poker game screen after dealing a hand from a deck.

FIG. 13 is an image of a main poker game screen after a player selects which cards to hold.

FIG. 14 is an image of a main poker game screen after the selected cards are held and the non-held cards are replaced with new cards drawn from the deck, wherein one of the drawn cards is a predefined special card (e.g., "Go Fish!" card) that triggers a special feature (e.g., "Go Fish!" feature).

FIG. 15 is an image of a main poker game screen wherein a player searches a set of additional cards behind the special card for a card to replace the special card (e.g., by tapping a "Go Fish!" button).

FIG. 16 is an image of a main poker game screen after a player selects one of the additional cards behind the special card to replace the special card, resulting in a winning poker hand ranking (e.g., "Four of a Kind").

FIG. 17 is an image of the pay table with the winning poker hand ranking highlighted.

FIG. 18 is an image of a main poker game screen prior to dealing a hand.

FIG. 19 is an image of a pay table.

FIG. 20 is an image of a main poker game screen after dealing a hand from a deck.

FIG. 21 is an image of a main poker game screen after a player selects which cards to hold.

FIGS. 22 and 23 are images of the main poker game screen after the selected cards are held and the non-held card is replaced with a new card drawn from the deck, wherein the drawn card is a predefined special card (e.g., "Black Wizard" card) that triggers a special feature (e.g., "Wild Wizard" feature).

FIG. 24 is an image of a main poker game screen wherein a player selects any black-suited card remaining in the deck to replace the special card.

FIG. 25 is an image of a main poker game screen after a player selects a black-suited card to replace the special card, resulting in a winning poker hand ranking (e.g., "Straight Flush").

Figure 1:
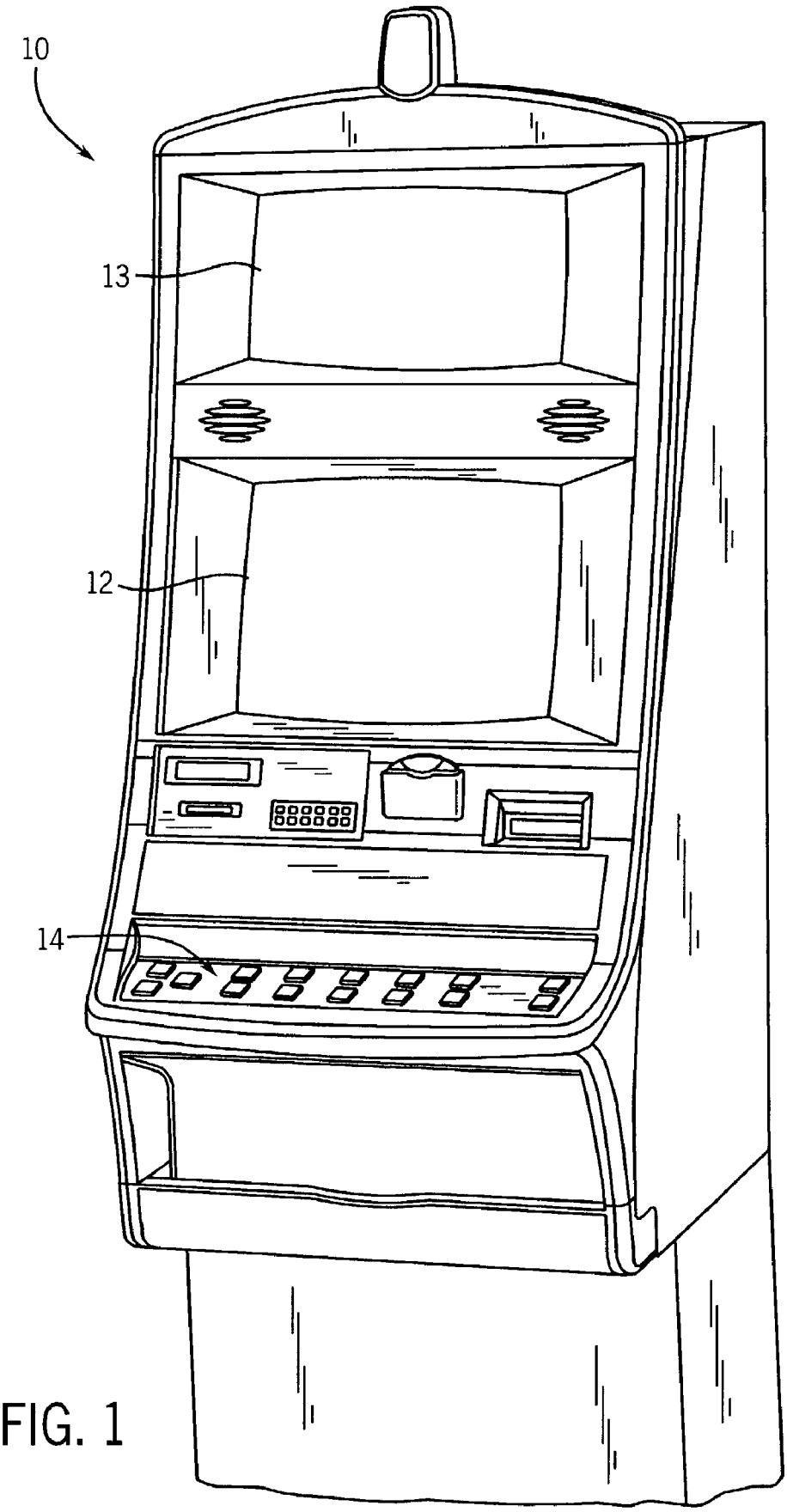
FIG. 1 is an isometric view of a gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings, FIG. 1 is an isometric view of a gaming machine 10 embodying the present invention. The gaming machine 10 is operable to conduct a video draw poker game having a special feature. The gaming machine 10 includes a pair of video displays 12 and 13. Each display is preferably a cathode ray tube, liquid crystal display, plasma or other type of video display known in the art. The lower display 12 is preferably outfitted with a touch screen to facilitate interaction with the player. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
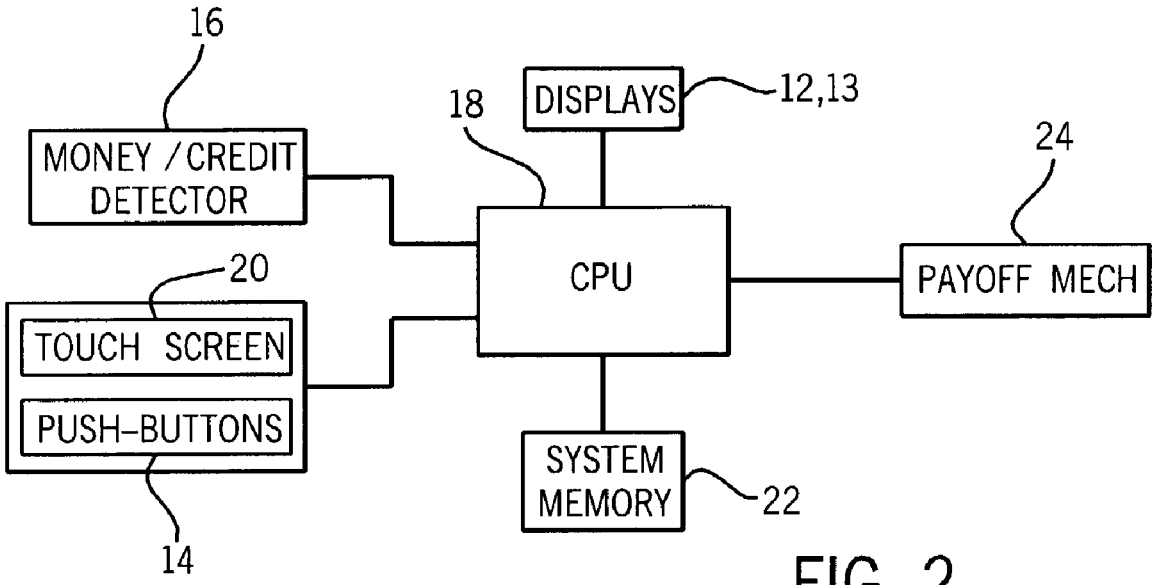
FIG. 2 is a block diagram of a control system suitable for operating the gaming machine.

FIG. 2 is a block diagram of a control system suitable for operating the gaming machine. Money/credit detector 16 signals a central processing unit (CPU) 18 when a player has inserted money or played a number of credits. The money may be provided by coins, bills, tickets, coupons, cards, etc. Using a button panel 14 (see FIG. 1) or a touch screen 20, the player may select various options associated with the video poker game, including a wager amount. For each play of the game, the CPU 18 generates at least one random event using a random number generator (RNG) and provides an award to the player for a winning outcome of the random event. The CPU 18 operates the display 12 to represent the random event(s) and outcome(s) in a visual form that can be understood by the player. In addition to the CPU 18, the control system may include one or more additional slave control units for operating one or more of the displays 12 and 13.

A system memory 22 stores control software, operational instructions and data associated with the gaming machine 10. In one embodiment, the system memory 22 comprises read-only memory (ROM), high capacity storage memory (e.g., Compact Flash), serial read-write memory, and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to any outcomes that include a payoff. The payoff may, for example, be in the form of a number of credits. The number of credits are determined by one or more math tables stored in the system memory 22.

FIGS. 3 through 17 illustrate a poker game entitled "Reel 'Em In Poker" in accordance with a first embodiment of the present invention. This video poker game is preferably played with a single standard 52-card deck (i.e., Ace through King of four different suits) plus at least one predefined special card (e.g., a "Go Fish!" card) for triggering a special "Go Fish!" feature. In some embodiments, the number of predefined special cards may exceed one. During a particular poker hand, all dealt and drawn cards come from the same deck. After a card is dealt or drawn from the deck into the poker hand, the card is "used up" and cannot appear again until the next poker hand. The deck is preferably replenished and randomly shuffled prior to every poker hand. The system memory 22 includes a data structure for storing data representing each card of the deck. The CPU 18 selects cards for each poker hand from the data structure and controls the lower video display 12 to display the cards.

Figure 3:
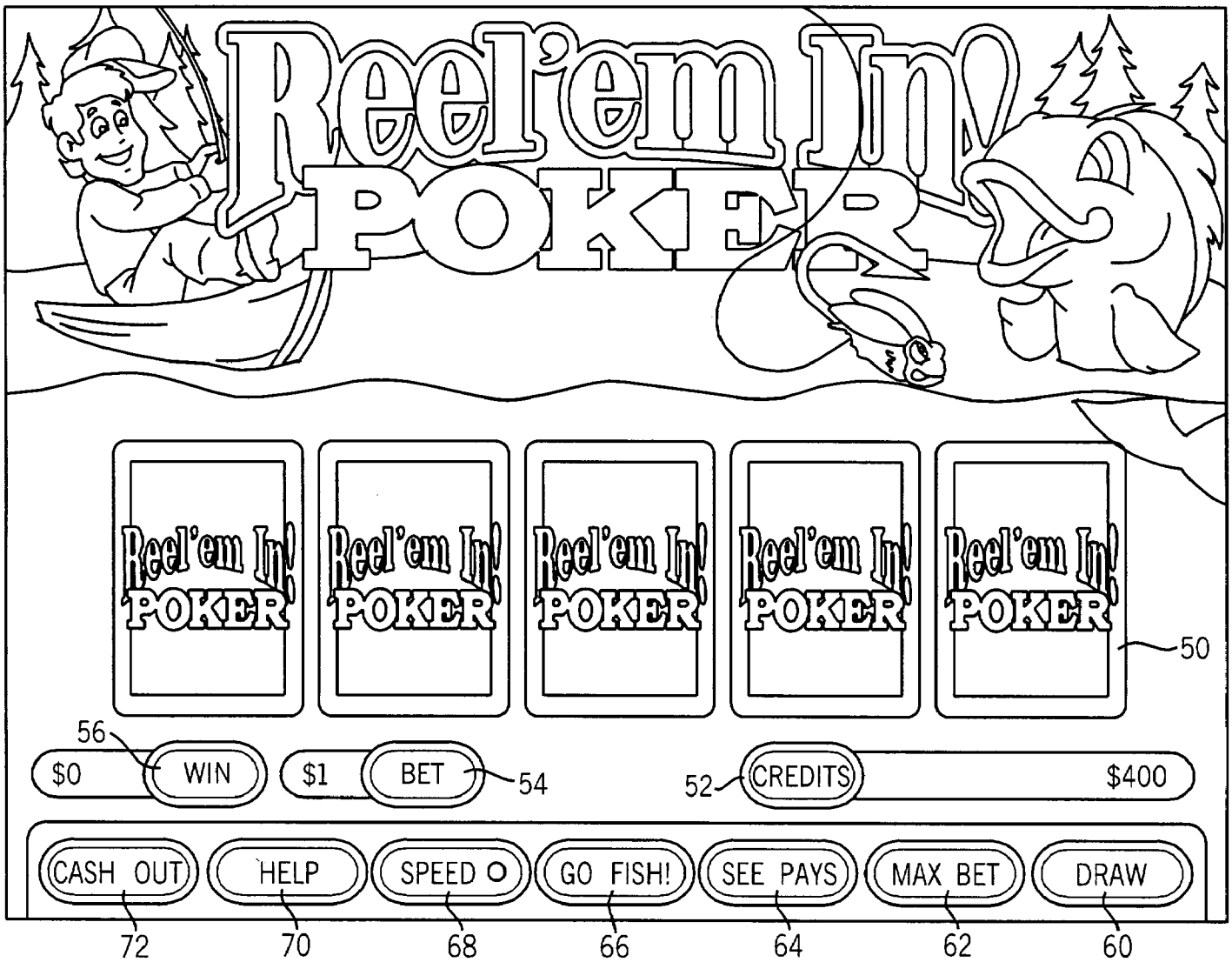
FIGS. 3 through 17 illustrate a poker game entitled "Reel 'Em In Poker" in accordance with a first embodiment of the present invention.

FIG. 3 is an image of a main poker game screen prior to dealing a poker hand. The main poker game screen is preferably shown on the lower video display 12. The main poker game screen is used to display playing cards 50, game session meters, and various buttons selectable by a player. The game session meters include a "credits" meter 52 for displaying a number of credits available for play on the machine; "bet" meter 54 for displaying a number of credits wagered (e.g., from 1 to 5 credits); and a "win" meter 56 for displaying a number of credits won as a result of the most recent play. The player-selectable buttons include a "deal/draw" button 60 for causing the game to initially deal cards from a deck into a hand and for later causing the game to draw cards from a deck to replace any non-held cards in the hand; a "max bet" button 62 for wagering a maximum number of credits (e.g., 5 credits); a "see pays" button 64 for viewing a pay table; a "Go Fish!" button 66 for use during a special "Go Fish!" feature that may be triggered during play of the video poker game; a "speed" button 68 for changing the speed at which cards are dealt from the deck (e.g., slow, medium, or fast); a "help" button 70 for viewing instructions on how to play the video poker game; and a "cash out" button 72 for collecting any credits remaining on the credits meter 52 at the end of a game session.

Figure 4:
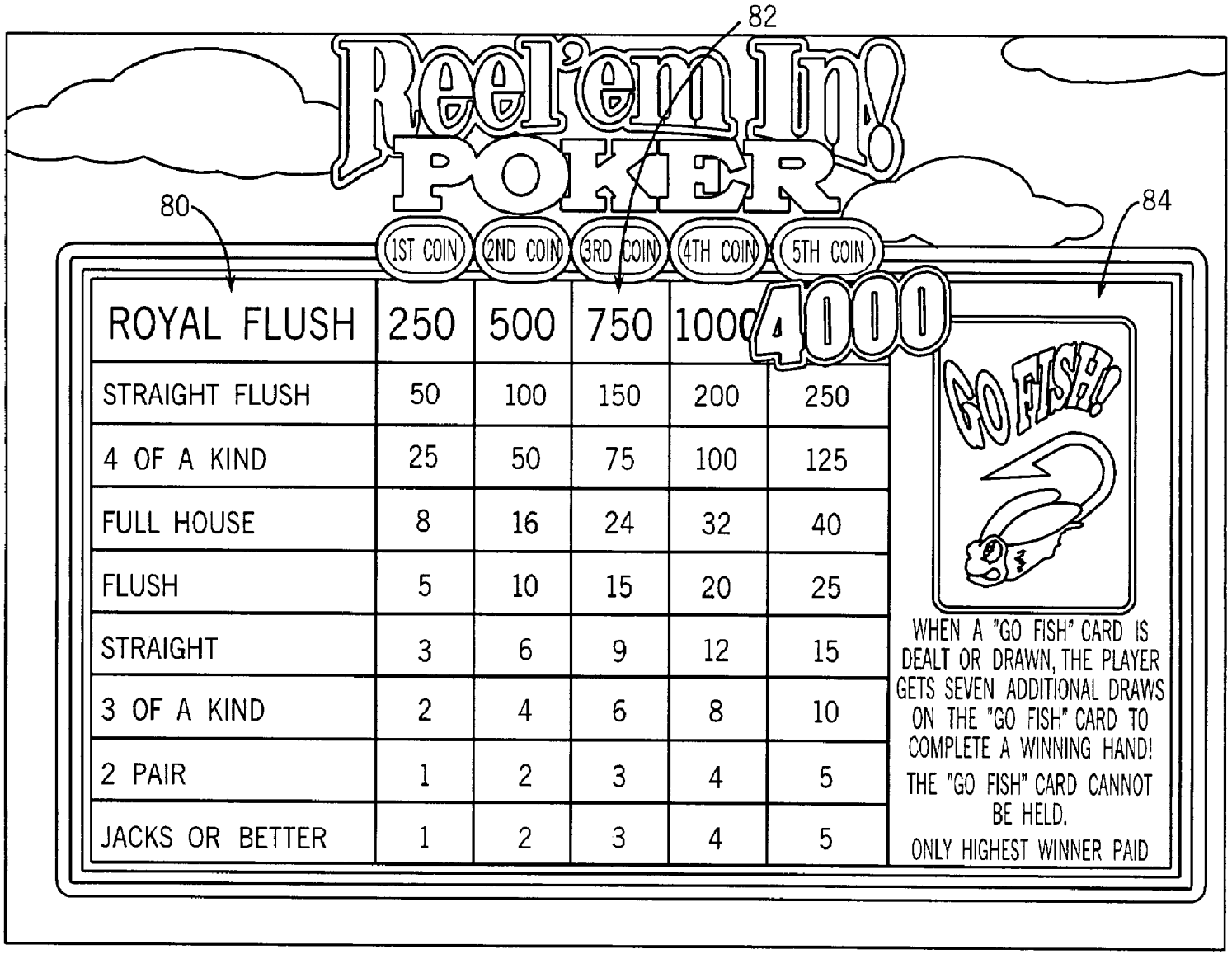

FIG. 4 is an image of a pay table, which is preferably shown on the upper video display 13. The pay table includes a list of winning poker hand rankings 80 and the number of credits won 82 for each ranking. The number of credits won is linearly proportional to the number of credits wagered, except that a royal flush yields a bonus when achieved on a maximum wager. Alongside the image of the pay table is an explanation 84 of the special "Go Fish!" feature.

FIGS. 5 through 17 are images representing three different basic scenarios that can occur during play of the video poker game.

Figure 5:
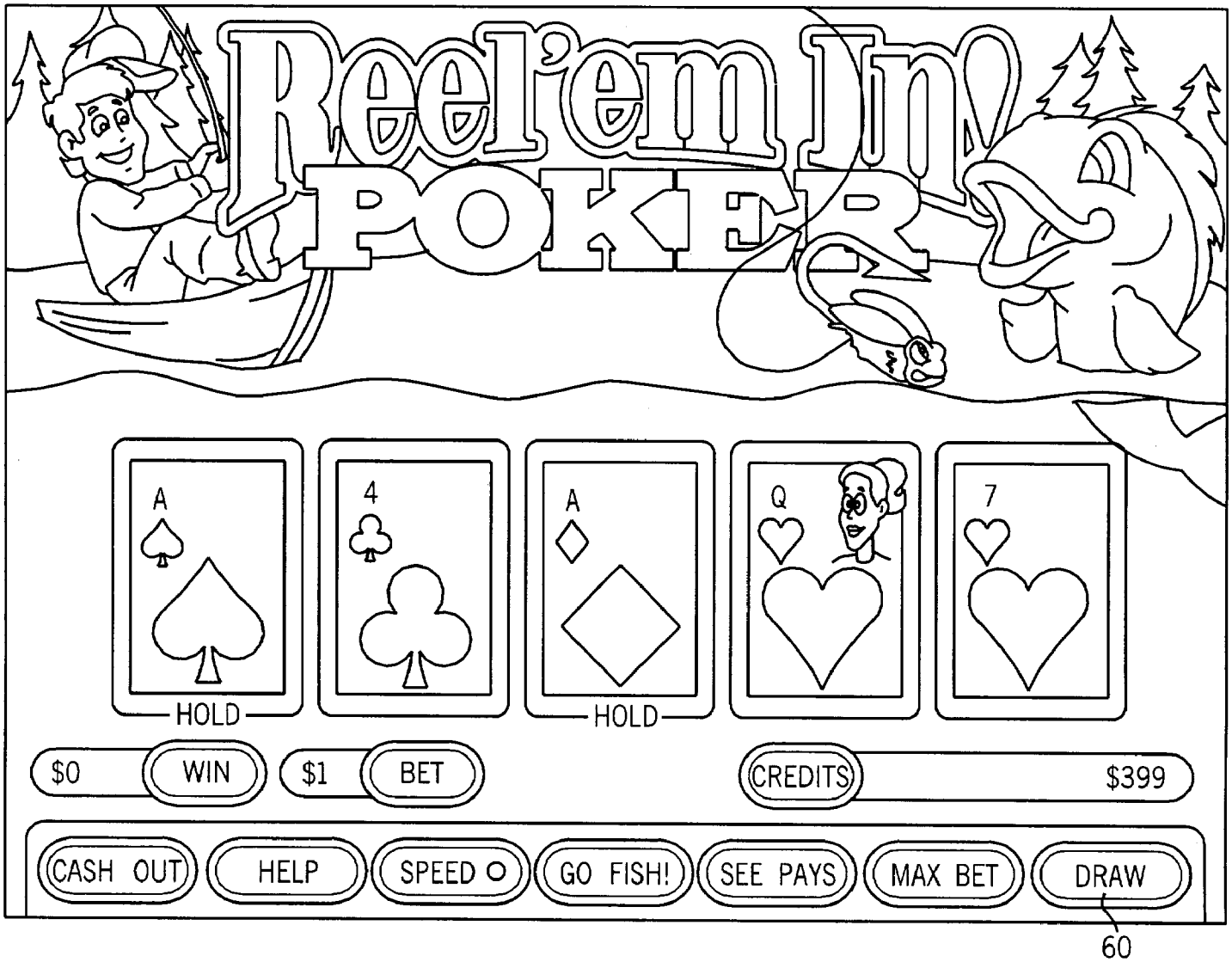
Figure 6:
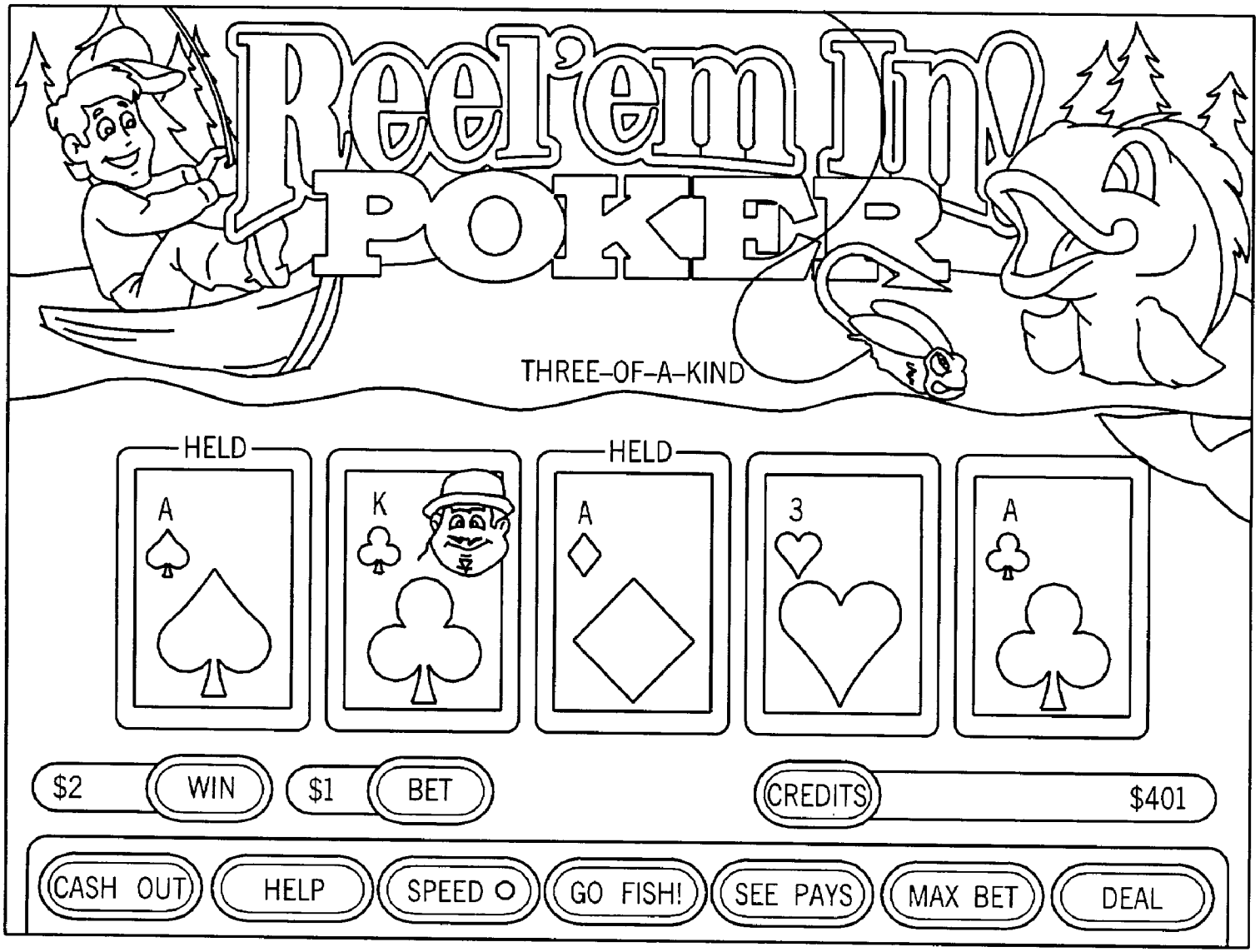
Figure 7:
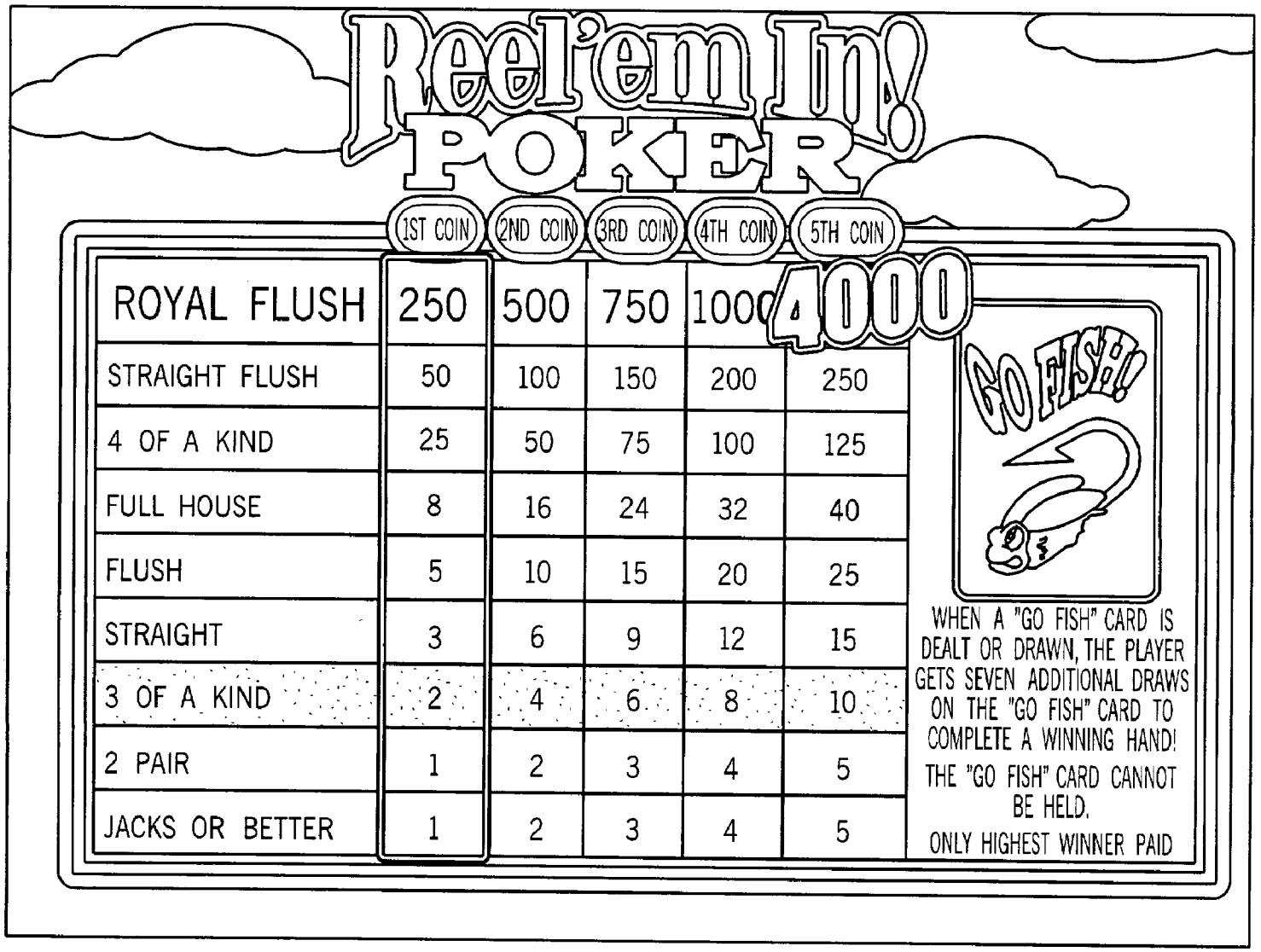

In a first scenario illustrated in FIGS. 5 through 7, the video poker game does not trigger the special "Go Fish!" feature. FIG. 5 is an image of a main poker game screen after a player (i) makes a wager of 1 credit ($1 dollar), (ii) is initially dealt five face-up cards from a shuffled deck into a poker hand, and (iii) selects which of the face-up cards to replace. The player indirectly selects which cards to replace by touching those cards that the player desires to hold. In an alternative embodiment, the player directly selects which cards to replace by touching those cards that the player desires to discard. In the illustrated example, the player is initially dealt a hand including A♠, 4♣, A♦, Q♥, and 7♥ and, as denoted by "hold" indicia beneath the cards, holds A♠and A♦. After the player touches those cards that the player wishes to hold, the player presses the "draw" button 60. FIG. 6 is an image of the main poker game screen after the selected cards are held and the non-held cards are replaced with new cards drawn from the deck. In the illustrated example, the draw results in a final hand including A♠, K♣, A♦, 3♥, and A♣. The game determines the poker hand ranking of the final poker hand to be 3 of a Kind. FIG. 7 is an image of the pay table with this winning poker hand ranking highlighted. On a wager of 1 credit, the award for 3 of a Kind is 2 credits.

Figure 8:
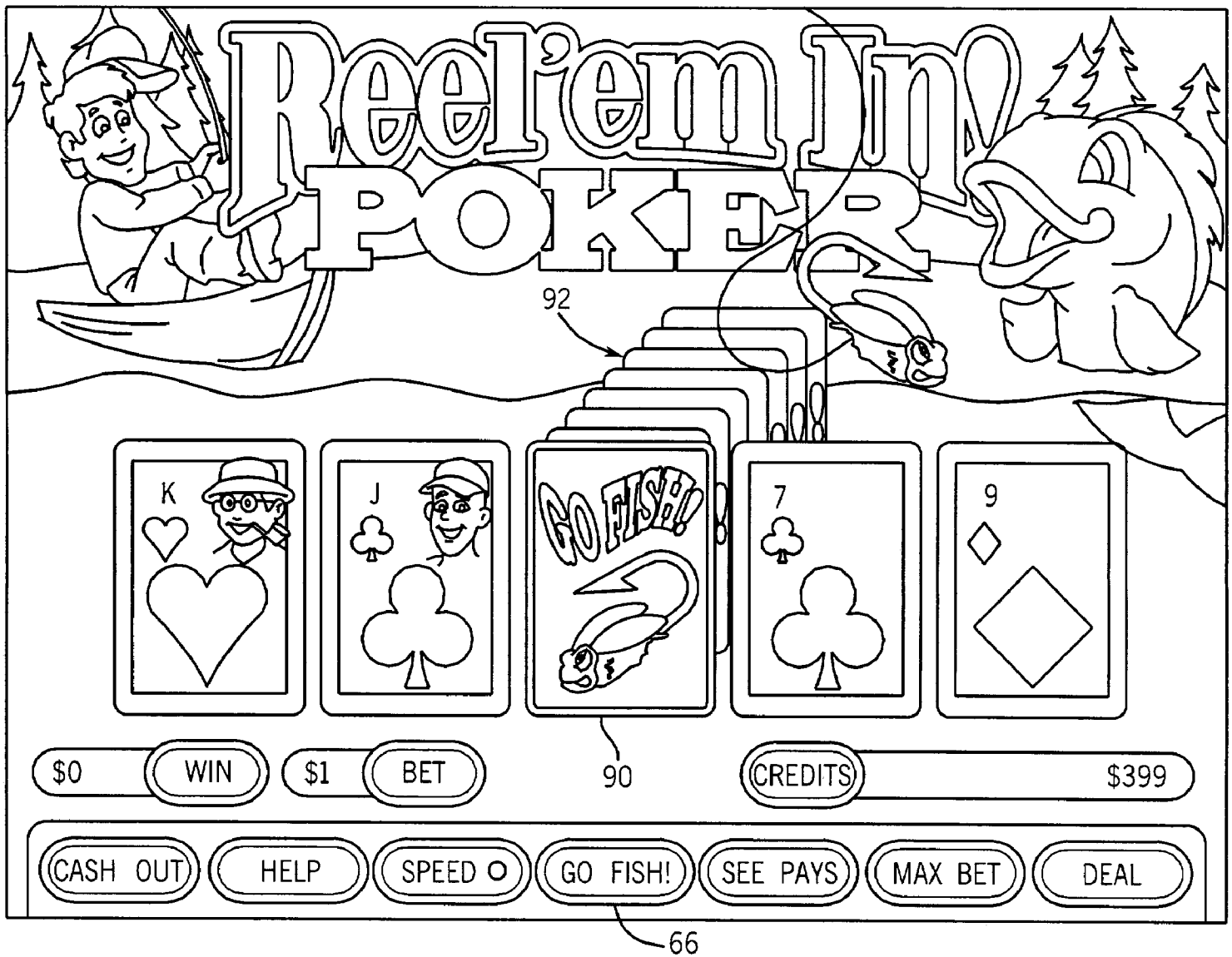
Figure 9:
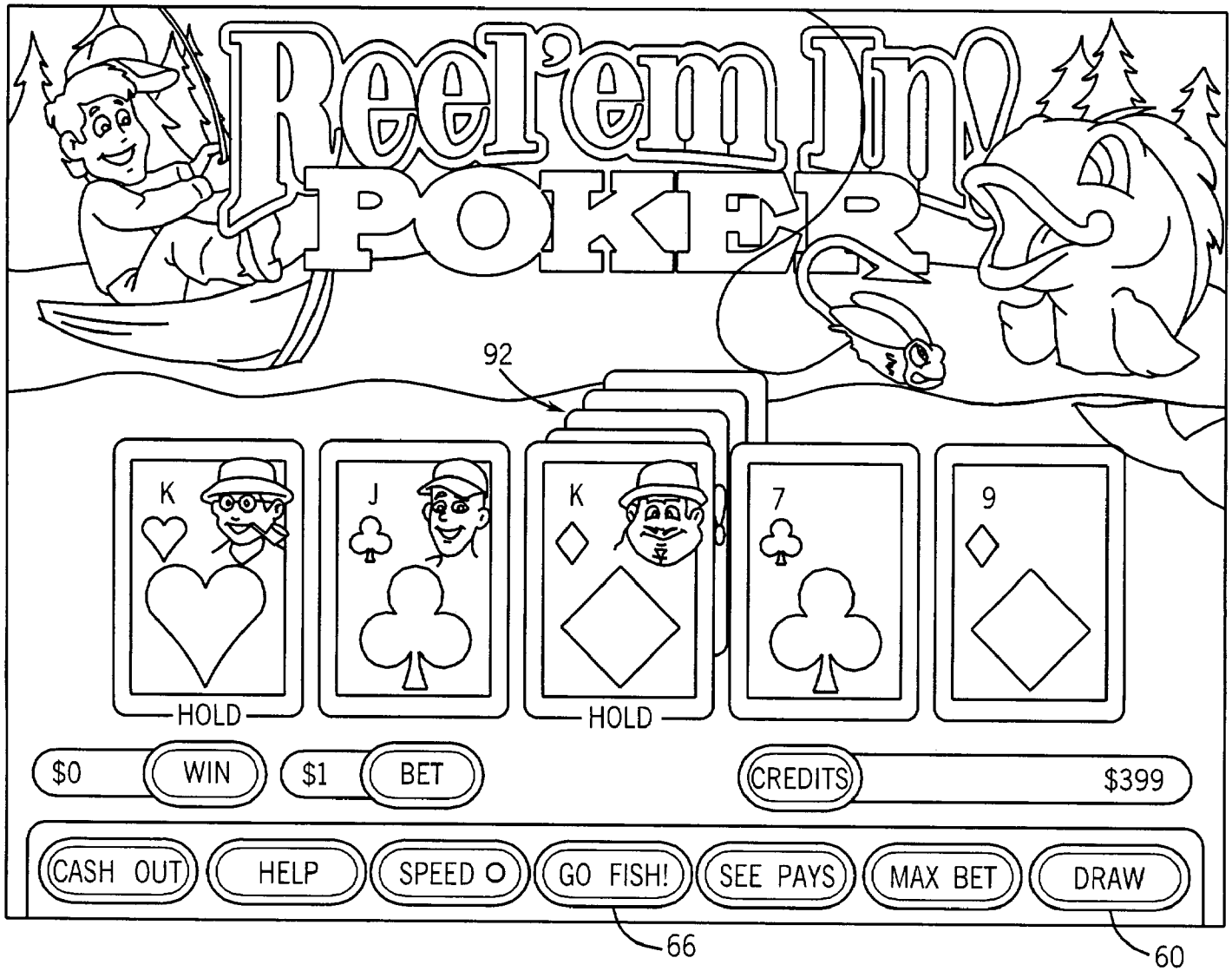
Figure 10:
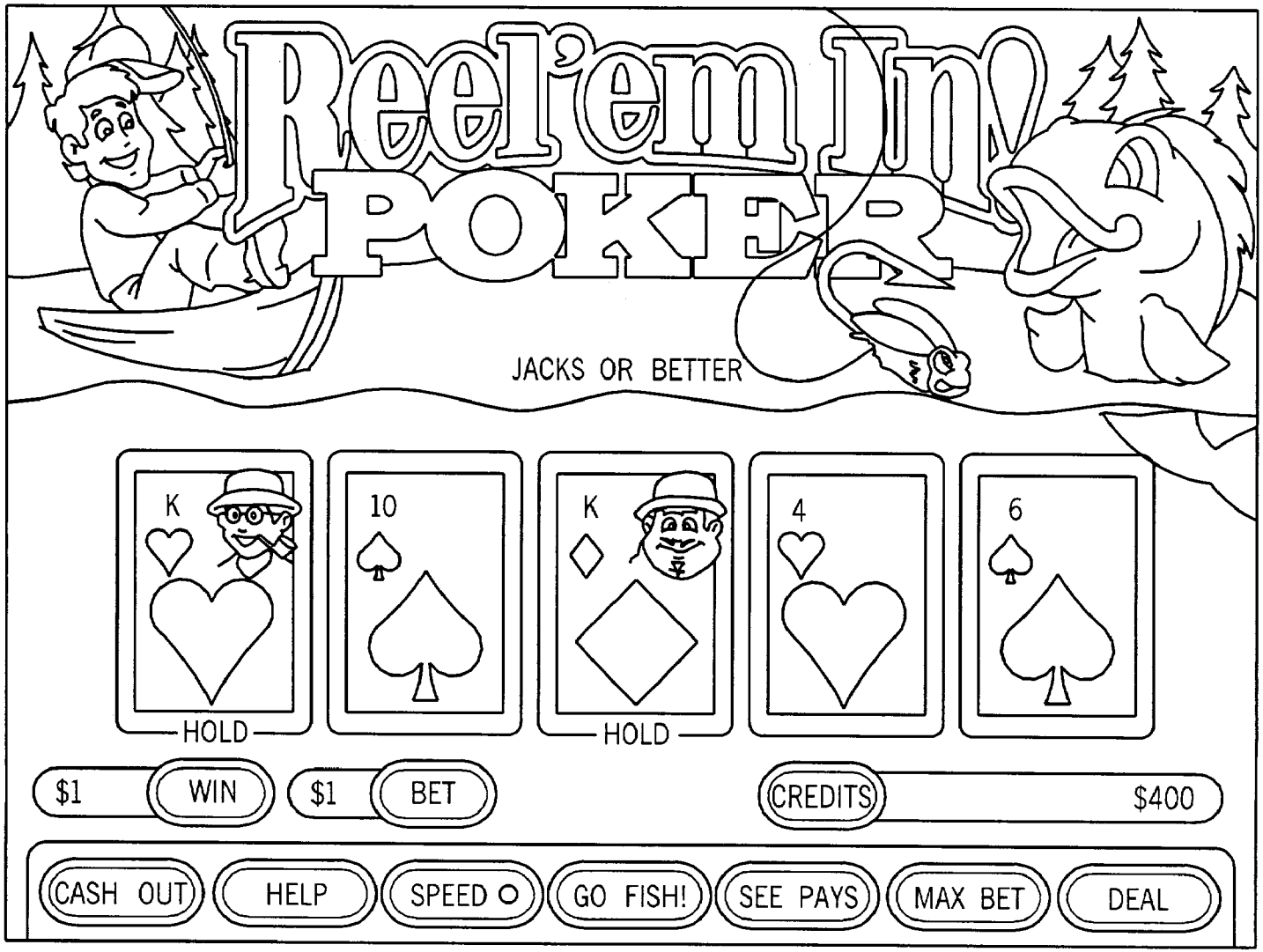
Figure 11:
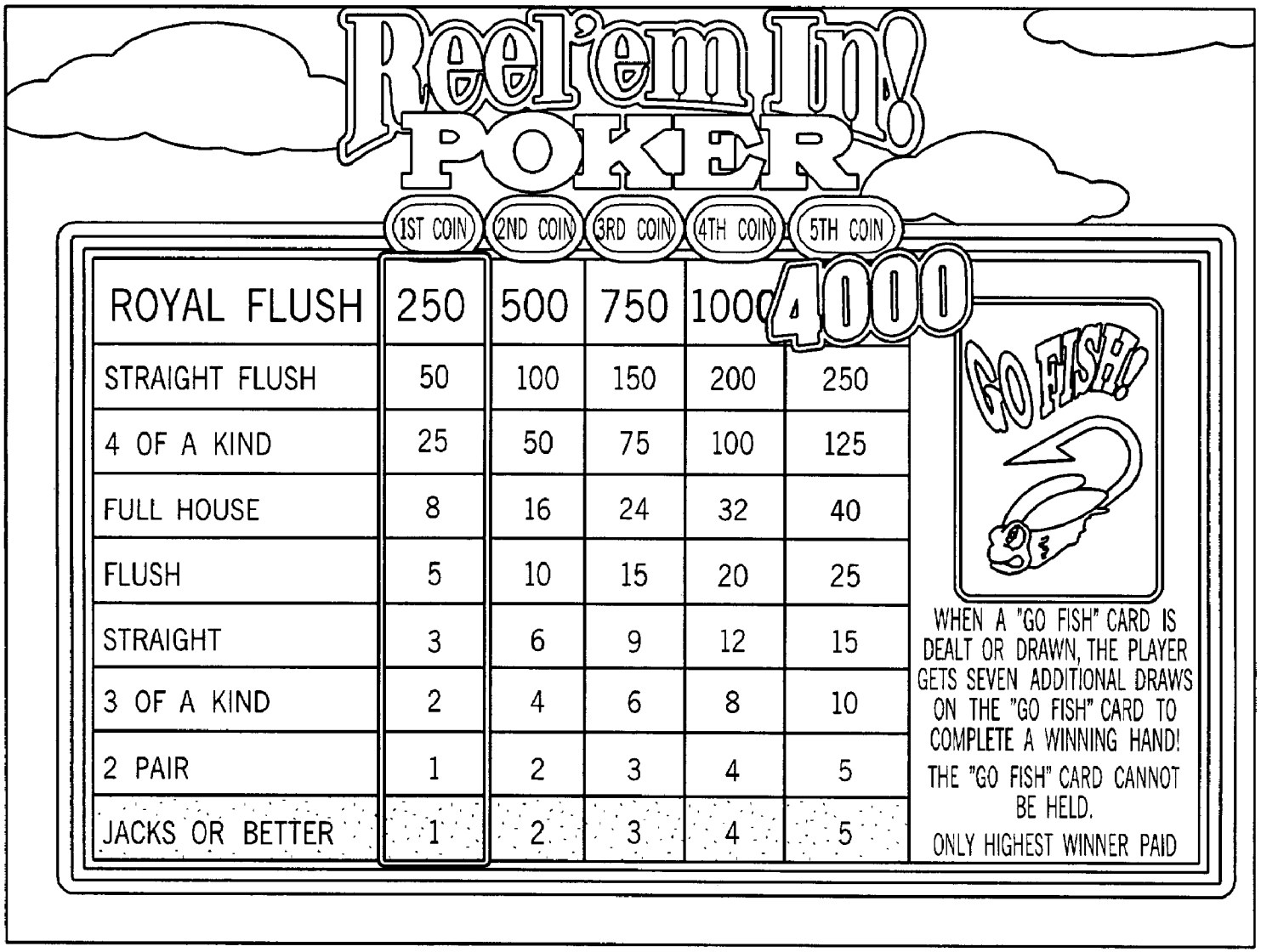

In a second scenario illustrated in FIGS. 8 through 11, the video poker game triggers the special "Go Fish!" feature prior to the draw. FIG. 8 is an image of a main poker game screen after a player (i) makes a wager of 1 credit ($1 dollar) and (ii) is initially dealt five face-up cards from a shuffled deck into a poker hand, wherein one of the dealt cards is a predefined special card (e.g., "Go Fish!" card) that triggers the special "Go Fish!" feature. In the illustrated example, the player is initially dealt a hand including K♥, J♣, 7♣, 9♦, and a "Go Fish!" card 90. When a "Go Fish!" card 90 is dealt, the player gets up to seven additional draws on the "Go Fish!" card 90. The seven additional draws are represented by a stack 92 of seven additional cards that appear behind the "Go Fish!" card 90. The stack 92 of seven additional cards preferably are from the deck used to play the video poker game and are not returned to the deck until the next poker hand. Referring to FIG. 9, the player taps the "Go Fish!" button 66 to select a card from the stack 92 of seven additional cards that were behind the "Go Fish!" card 90 in FIG. 8. Each tap of the "Go Fish!" button 66 turns the next card in the stack 92 face up and removes the preceding card from the stack 92 so that it can no longer be selected. In other words, once a player passes up a card in favor of the next card in the stack 92, the player cannot back track through the stack to select the card that was previously passed up. After the player is satisfied with a revealed card in the stack 92 (or reaches the last card in the stack 92 and therefore has no choice but to accept that last card), the player stops tapping the "Go Fish!" button 66. In the illustrated example, the player stops tapping the "Go Fish!" button 66 after revealing K♦, so the poker hand now includes K♥, J♣, 7♣, 9♦, and K♦. The player then selects which cards in the hand to hold by touching those cards that the player desires to hold. As denoted by "hold" indicia beneath the cards, in the illustrated example the player holds K♥ and K♦ and then presses the "draw" button 60. FIG. 10 is an image of the main poker game screen after the selected cards are held and the non-held cards are replaced with new cards drawn from the deck. In the illustrated example, the draw results in a final hand including K♥, 10♠, K♦, 4♥, and 6♠. The game determines the poker hand ranking of the final poker hand to be Jacks or Better. FIG. 11 is an image of the pay table with this winning poker hand ranking highlighted. On a wager of 1 credit, the award for Jacks or Better is 1 credit.

Figure 12:
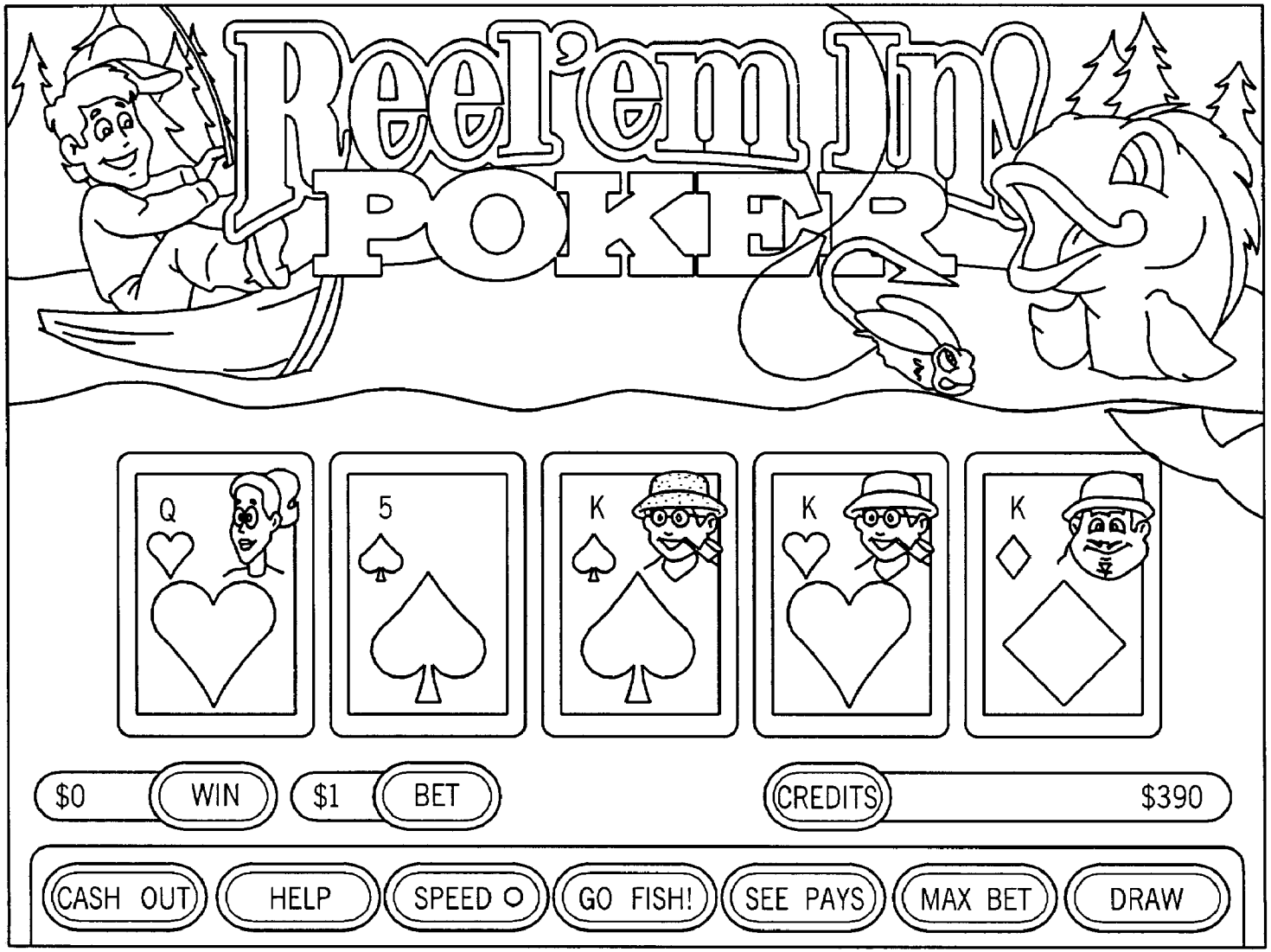
Figure 13:
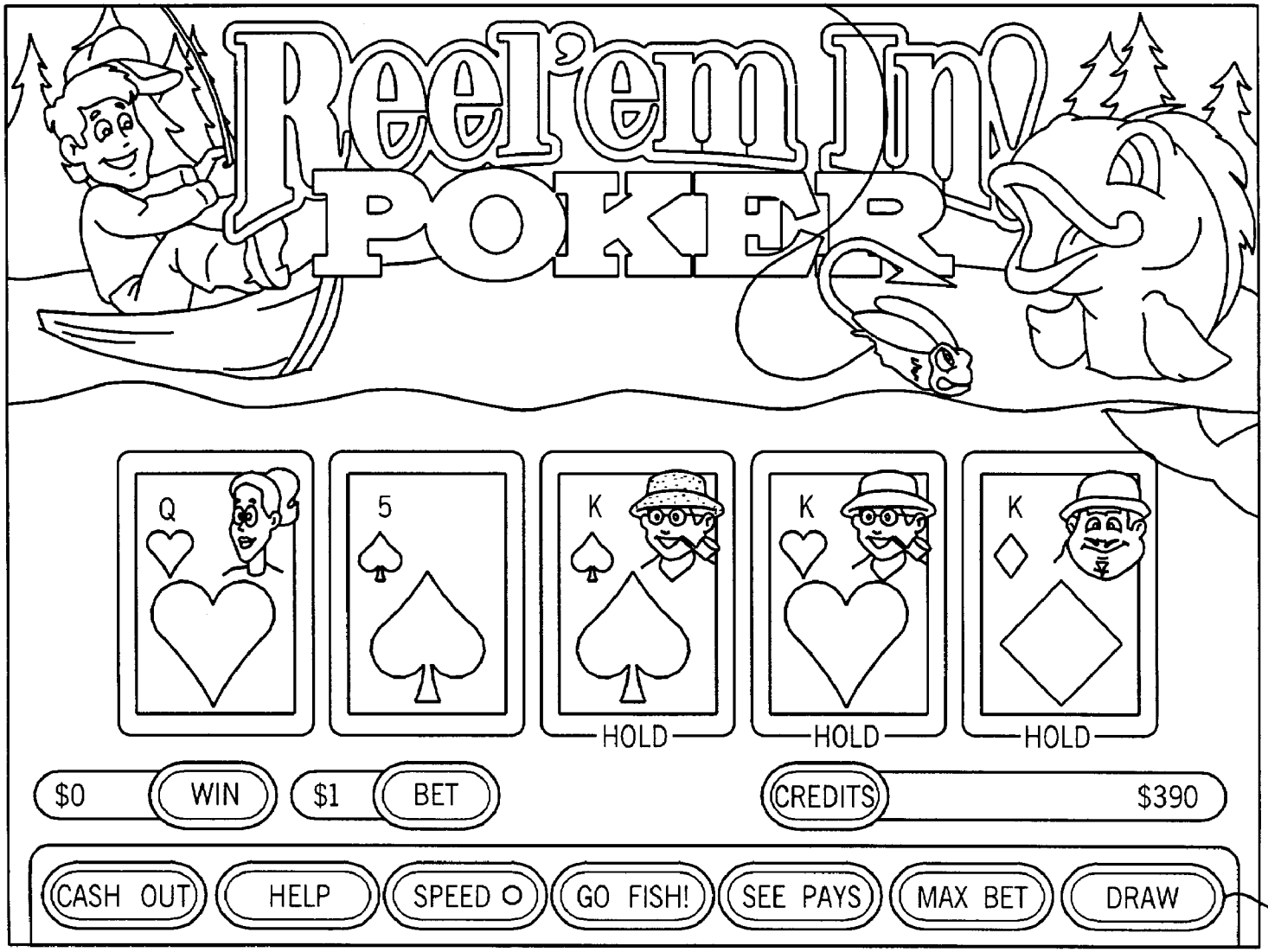
Figure 14:
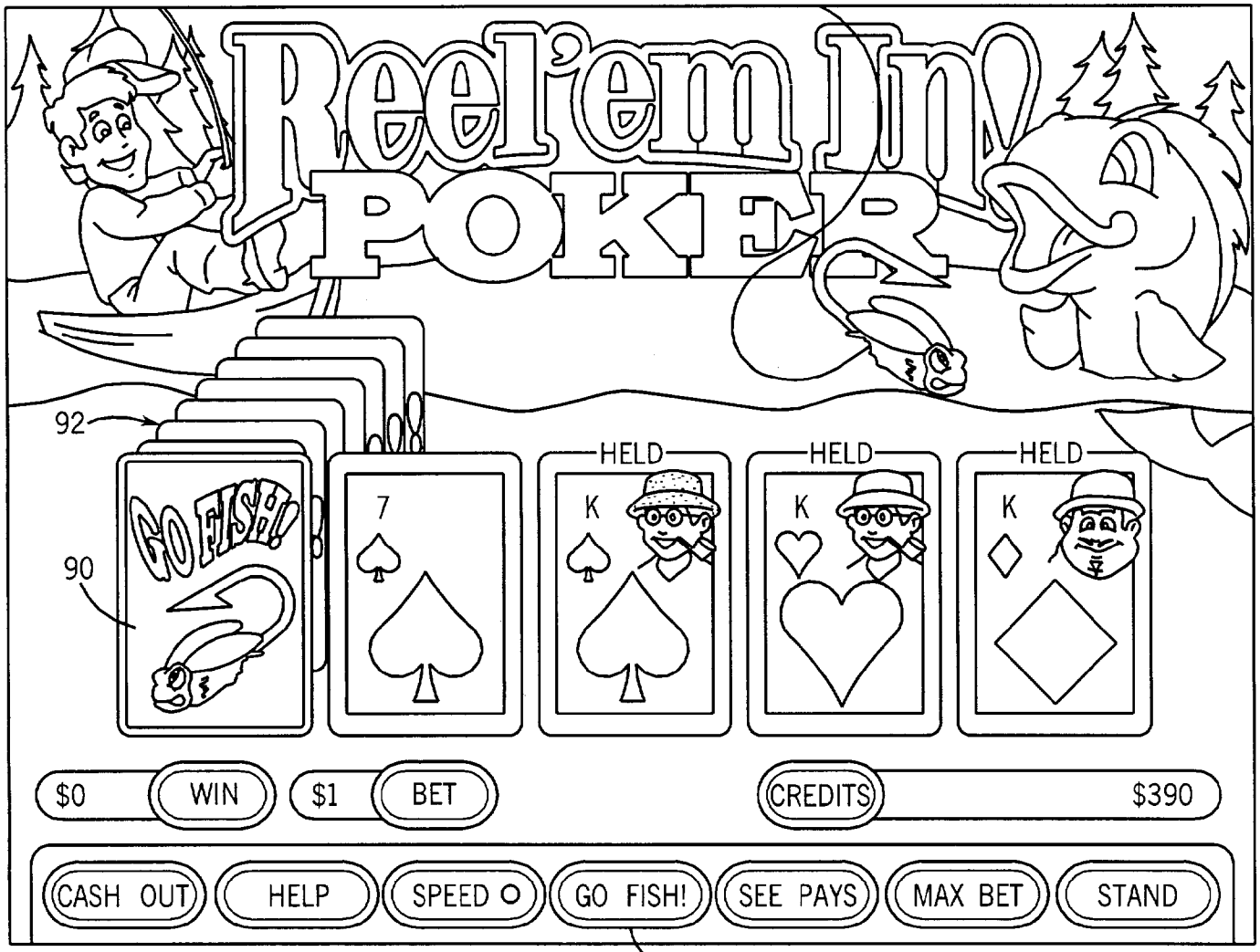
Figure 15:
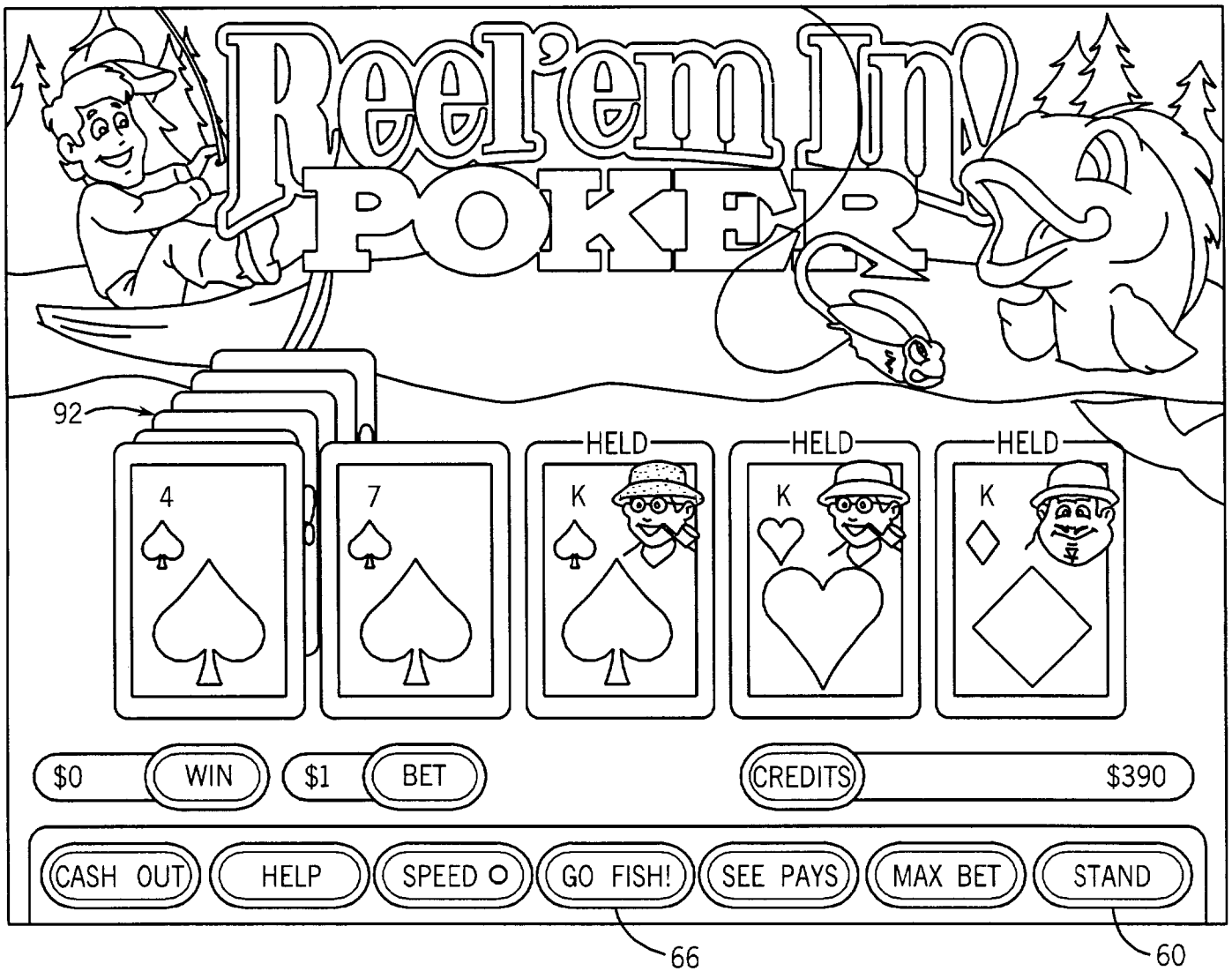
Figure 16:
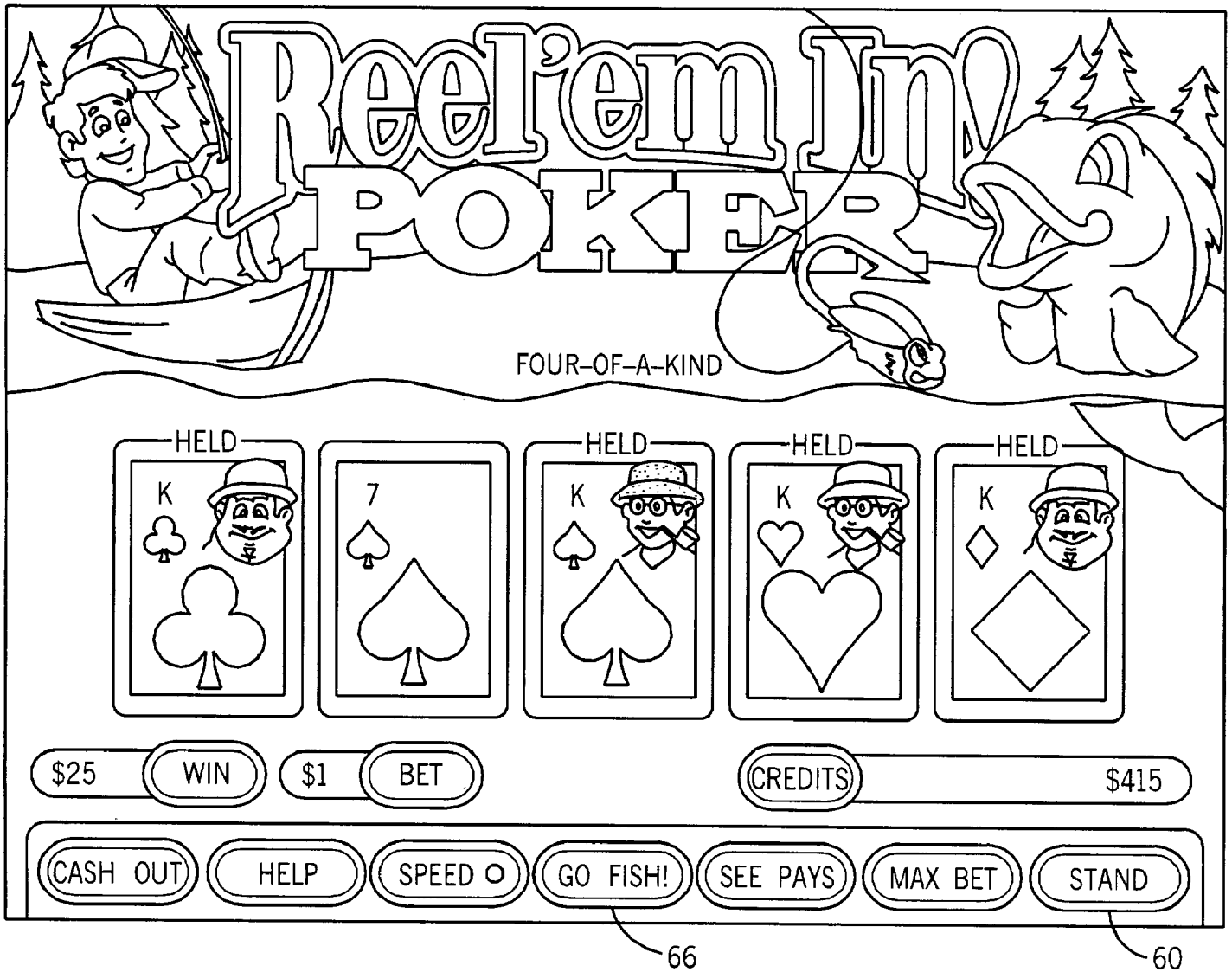
Figure 17:
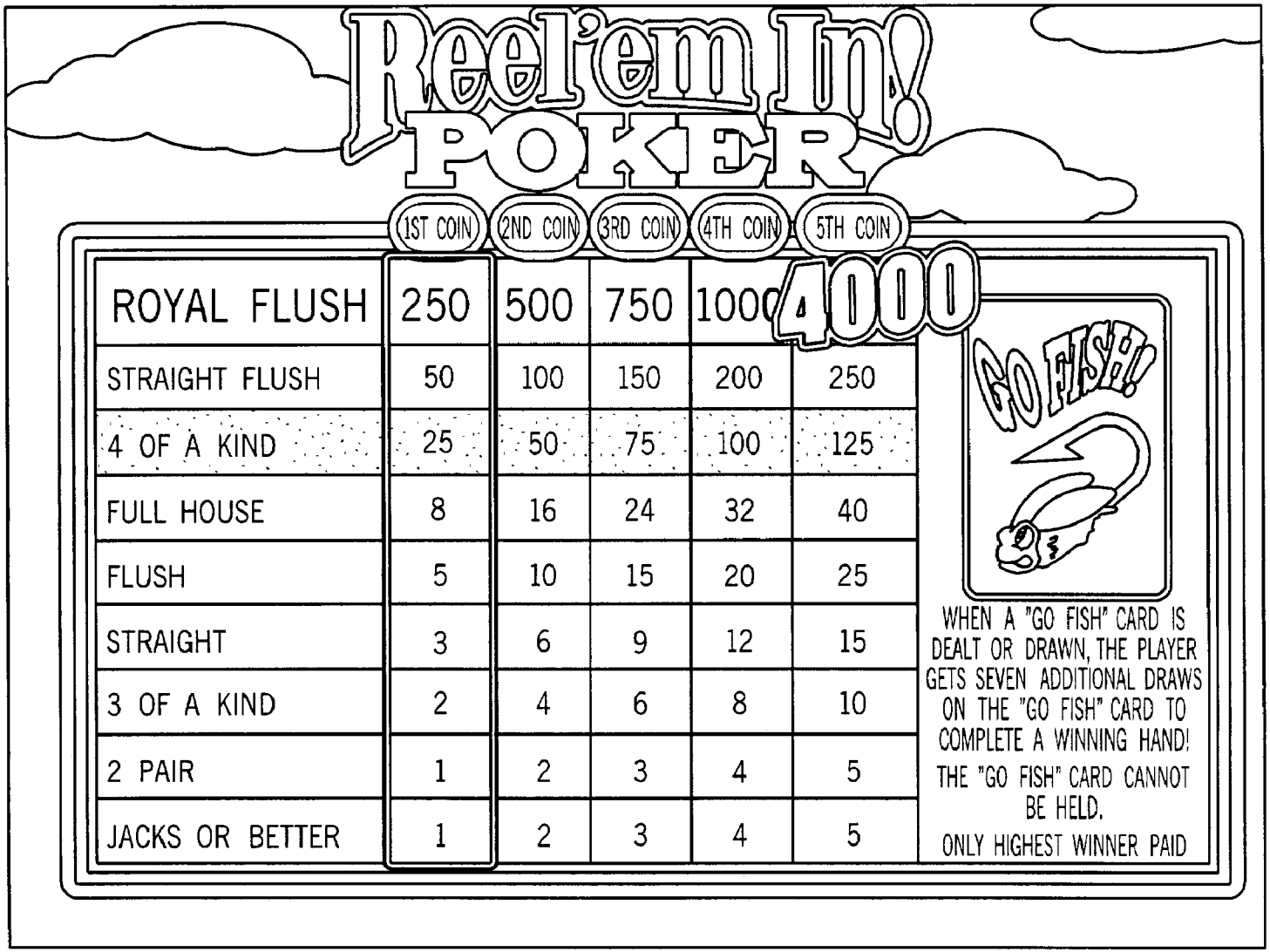

In a third scenario illustrated in FIGS. 12 through 17, the video poker game triggers the special "Go Fish!" feature after the draw. FIG. 12 is an image of a main poker game screen after a player (i) makes a wager of 1 credit ($1 dollar) and (ii) is initially dealt five face-up cards from a shuffled deck into a poker hand. In the illustrated example, the player is initially dealt a hand including Q♥, 5♠, K♠, K♥, and K♦. FIG. 13 is an image of the main poker game screen after the player selects which cards to hold by touching those cards that the player wishes to hold. In the illustrated example, the player holds K♠, K♥, and K♦ and then presses the "draw" button 60. FIG. 14 is an image of the main poker game screen after the selected cards are held and the non-held cards are replaced with new cards drawn from the deck, wherein one of the drawn cards is the "Go Fish!" card 90 that triggers the special "Go Fish!" feature. In the illustrated example, the poker hand now includes a "Go Fish!" card 90, 7♠, K♠, K♥, and K♦. When a "Go Fish!" card 90 is drawn on the draw, the player gets up to seven additional draws on the "Go Fish!" card 90. The seven additional draws are represented by the stack 92 of seven additional cards that appear behind the "Go Fish!" card 90. The stack 92 of seven additional cards preferably are from the deck used to play the video poker game and are not returned to the deck until the next poker hand. Referring to FIGS. 15 and 16, the player taps the "Go Fish!" button 66 to select a card from the stack 92 of seven additional cards that were behind the "Go Fish!" card 90 in FIG. 14. Each tap of the "Go Fish!" button 66 turns the next card in the stack 92 face up and removes the preceding card from the stack 92 so that it can no longer be selected. In other words, once a player passes up a card in favor of the next card in the stack 92, the player cannot back track through the stack to select the card that was previously passed up. After the player is satisfied with a revealed card in the stack 92, the player stops tapping the "Go Fish!" button 66 and presses the "stand" button 60 (previously labeled "draw"). The player need not press the "stand" button 60 if the player reaches the last card in the stack 92 and therefore has no choice but to accept that last card. In the illustrated example, the player stops tapping the "Go Fish!" button 66 after revealing K♣, so the final poker hand now includes K♣, 7♠, K♠, K♥, and K♦. The game determines the poker hand ranking of the final poker hand to be Four of a Kind. FIG. 17 is an image of the pay table with this winning poker hand ranking highlighted. On a wager of 1 credit, the award for Four of a Kind is 25 credits.

FIGS. 18 through 25 illustrate a video poker game entitled "Wild Wizard Poker" in accordance with a second embodiment of the present invention. This video poker game is preferably played with a single standard 52-card deck (i.e., Ace through King of four different suits) plus at least two predefined special cards (e.g., a "Black Wizard" wild card and a "Red Wizard" wild card) for triggering a special "Wild Wizard" feature. In some embodiments, the number of predefined special cards may exceed two. During a particular poker hand, all dealt and drawn cards come from the same deck. After a card is dealt or drawn from the deck into the poker hand, the card is "used up" and cannot appear again until the next poker hand. The deck is preferably replenished and randomly shuffled prior to every poker hand. The system memory 22 includes a data structure for storing data representing each card of the deck. The CPU 18 selects cards for each poker hand from the data structure and controls the lower video display 12 to display the cards.

Figure 18:
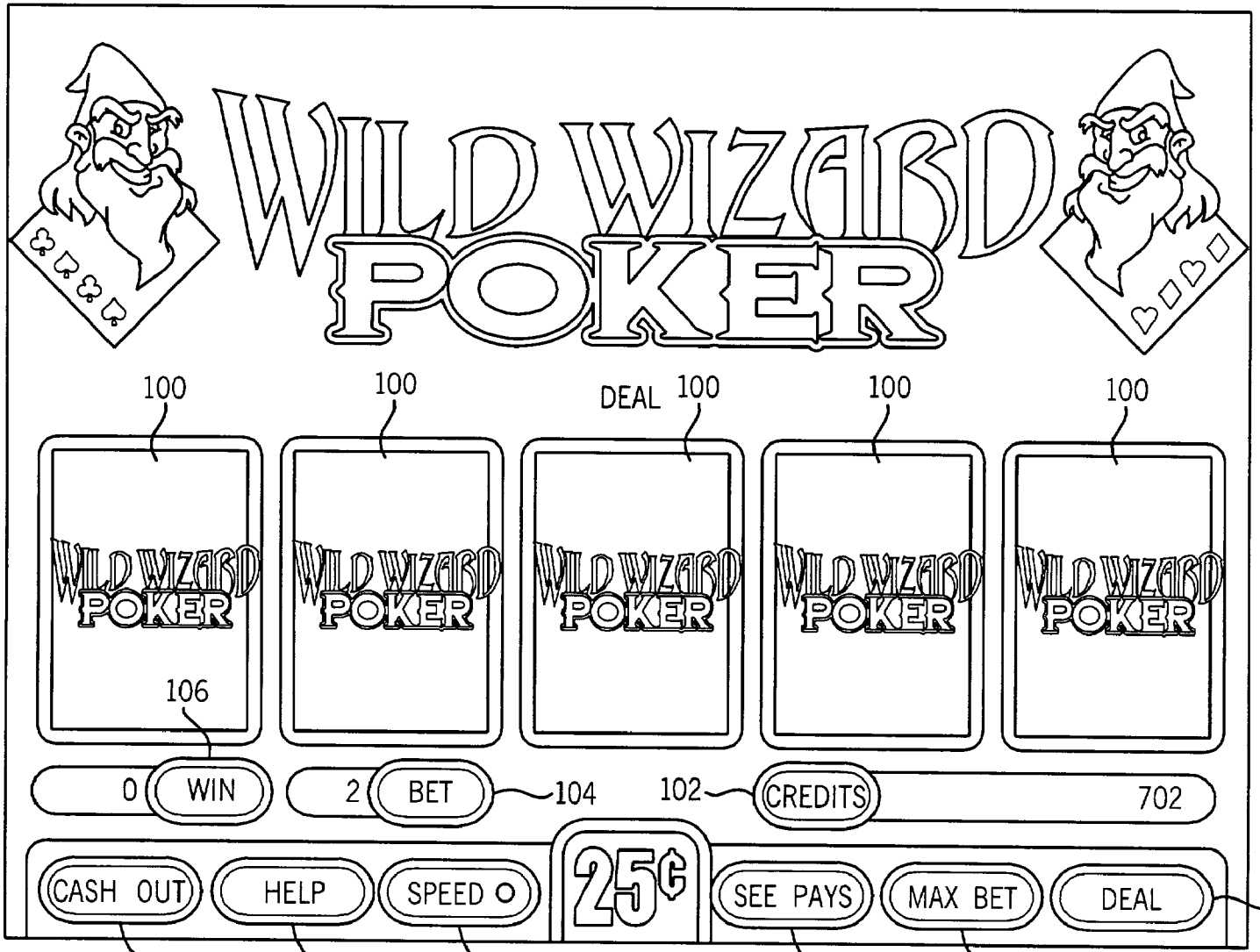
FIGS. 18 through 25 illustrate a video poker game entitled "Wild Wizard Poker" in accordance with a second embodiment of the present invention.

FIG. 18 is an image of a main poker game screen prior to dealing a poker hand. The main poker game screen is preferably shown on the lower video display 12. The main poker game screen is used to display playing cards 100, game session meters, and various buttons selectable by a player. The game session meters include a "credits" meter 102 for displaying a number of credits available for play on the machine; "bet" meter 104 for displaying a number of credits wagered (e.g., from 1 to 5 credits); and a "win" meter 106 for displaying a number of credits won as a result of the most recent play. The player-selectable buttons include a "deal/draw" button 110 for causing the game to initially deal cards from a deck into a hand and for later causing the game to draw cards from a deck to replace any non-held cards in the hand; a "max bet" button 112 for wagering a maximum number of credits (e.g., 5 credits); a "see pays" button 114 for viewing a pay table; a "speed" button 118 for changing the speed at which cards are dealt from the deck (e.g., slow, medium, or fast); a "help" button 120 for viewing instructions on how to play the video poker game; and a "cash out" button 122 for collecting any credits remaining on the credits meter 102 at the end of a game session.

Figure 19:
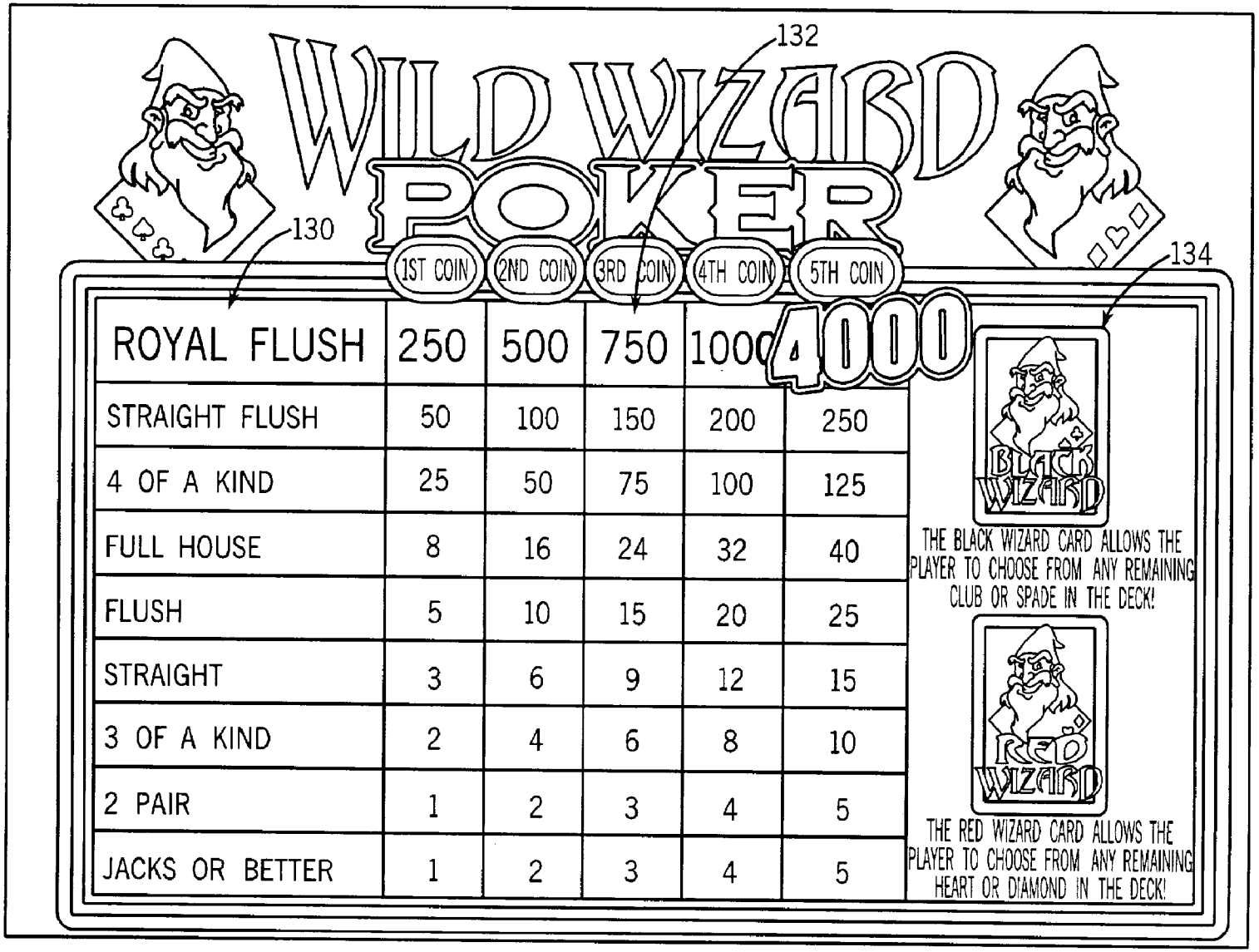

FIG. 19 is an image of a pay table, which is preferably shown on the upper video display 13. The pay table includes a list of winning poker hand rankings 130 and the number of credits won 132 for each ranking. The number of credits won is linearly proportional to the number of credits wagered, except that a royal flush yields a bonus when achieved on a maximum wager. Alongside the image of the pay table is an explanation 134 of the special "Wild Wizard" feature.

Figure 20:
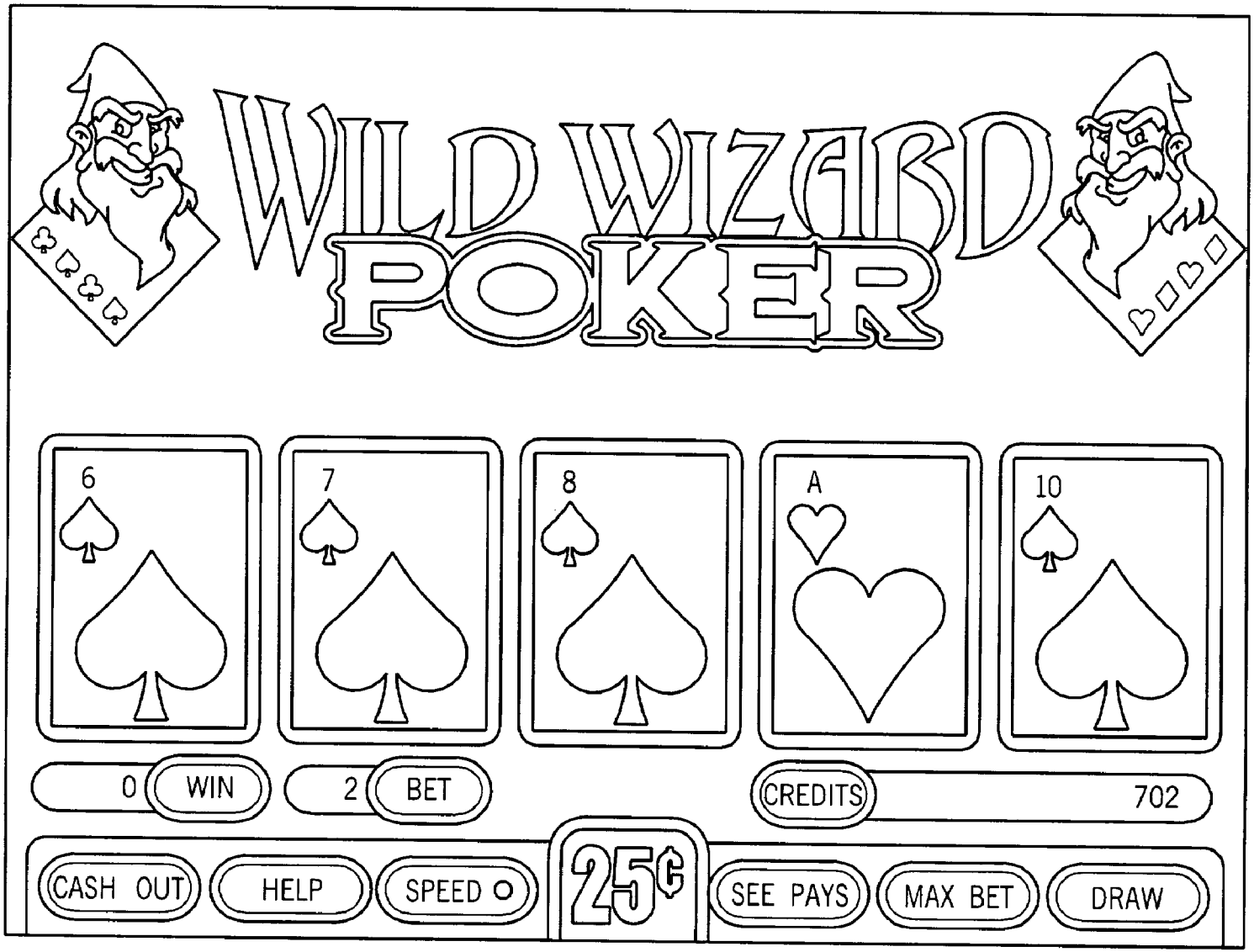
Figure 21:
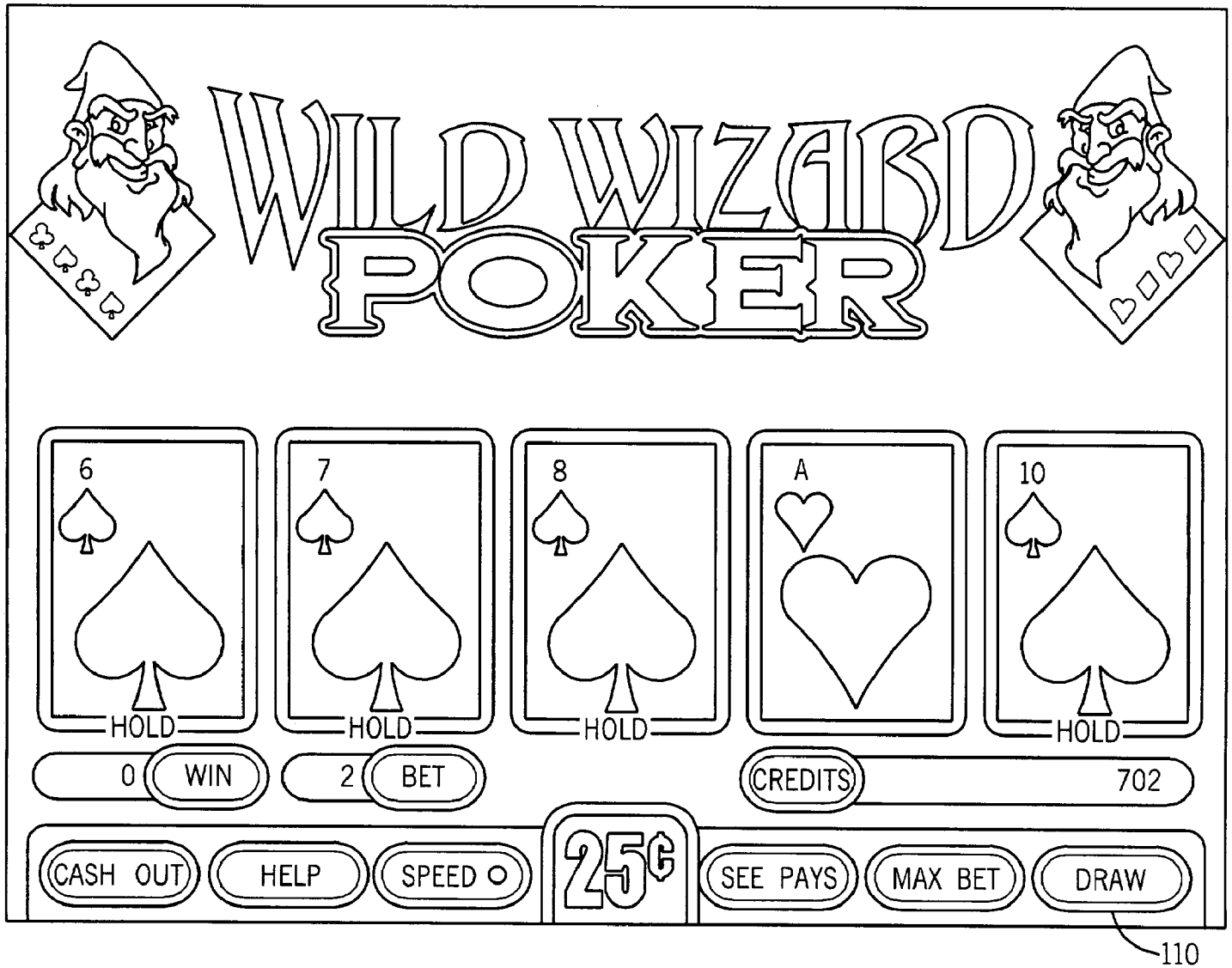

FIG. 20 is an image of a main poker game screen after a player (i) makes a wager of 2 credits and (ii) is initially dealt five face-up cards from a shuffled deck into a poker hand. In the illustrated example, the player is initially dealt a hand including 6♠, 7♠, 8♠, A♥, and 10♠. FIG. 21 is an image of the main poker game screen after the player selects which cards to hold by touching those cards that the player wishes to hold. In the illustrated example, the player holds 6♠, 7♠, 8♠, and 10♠ and then presses the "draw" button 110.

Figure 22:
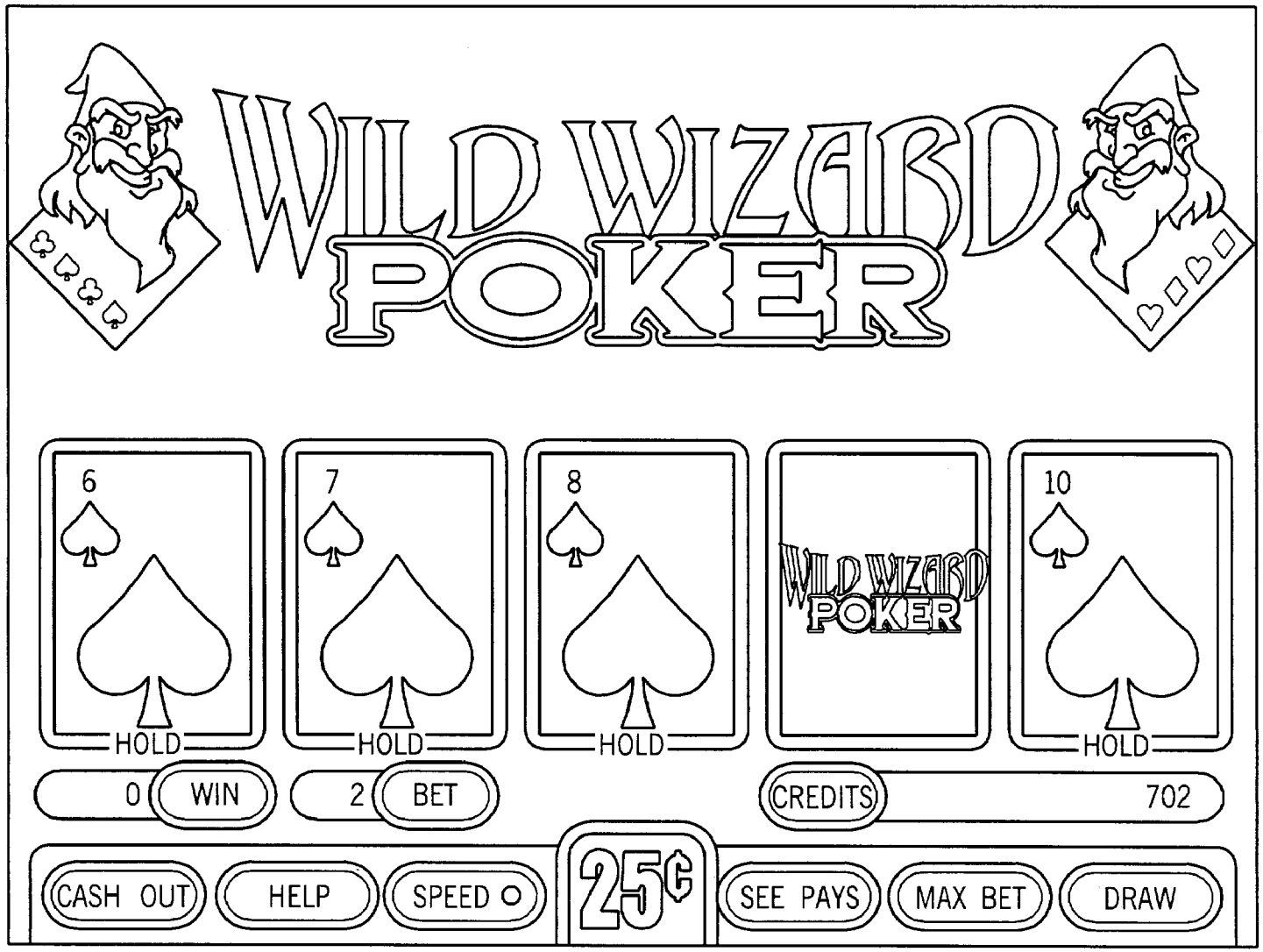
Figure 23:
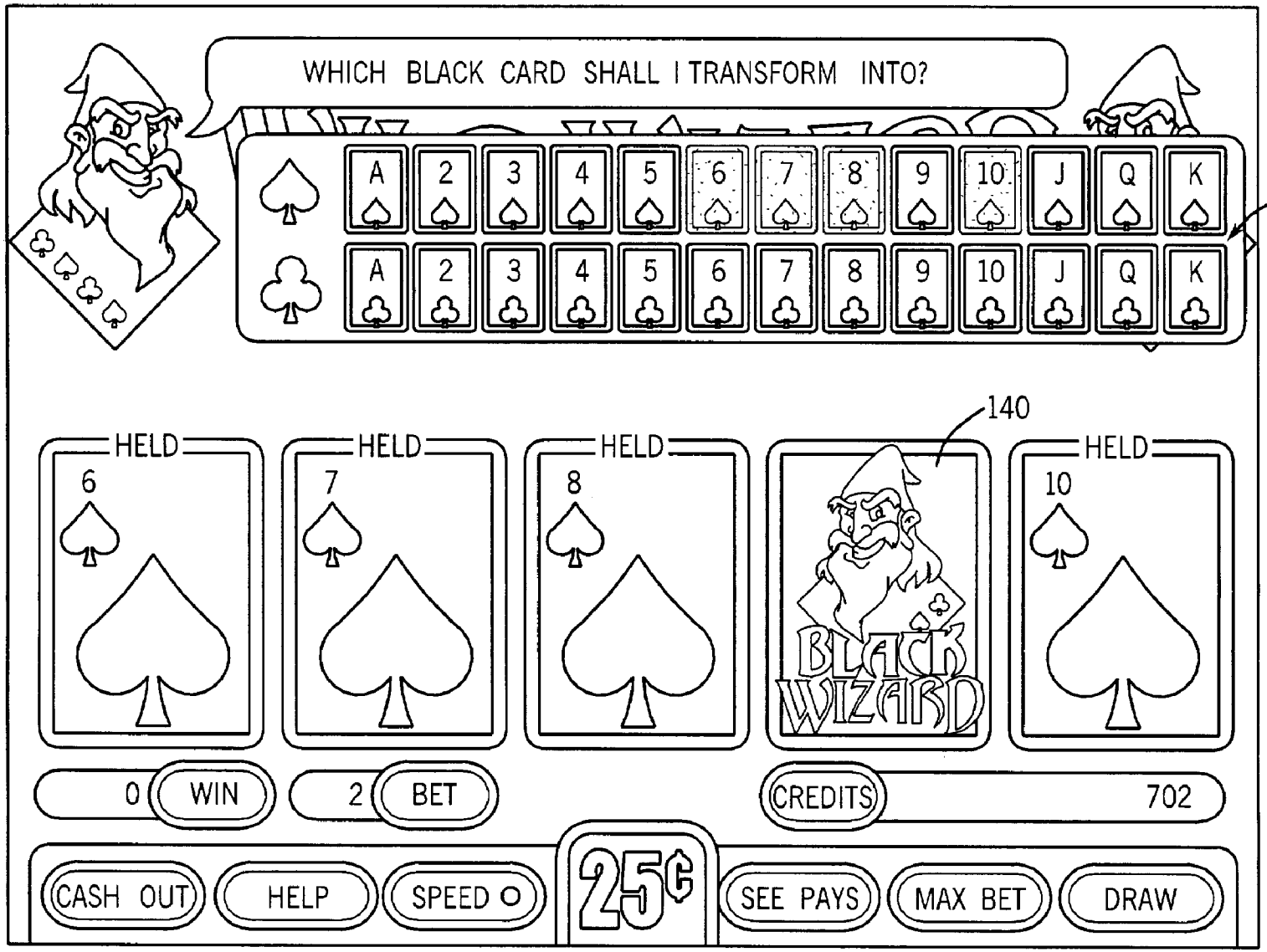

FIGS. 22 and 23 are images of the main poker game screen after the selected cards are held and the non-held card is replaced with a new card drawn from the deck, wherein the drawn card is a "Black Wizard" card 140 that triggers the special "Wild Wizard" feature. In the illustrated example, the poker hand now includes a "Black Wizard" card 140, 6♠, 7♠, 8♠, and 10♠. When a "Black Wizard" card 140 is dealt on the deal or the draw, the player is allowed to replace the "Black Wizard" card 140 with any remaining black-suited card (e.g., club or spade) in the deck. The black-suited cards are shown in an upper portion 142 of the main poker game screen, with any cards unavailable (used) for selection being grayed out. Conversely, if a "Red Wizard" card had been dealt on the deal or the draw, the player would have been allowed to replace the "Red Wizard" card with any remaining red-suited card (e.g., heart or diamond) in the deck.

Figure 24:
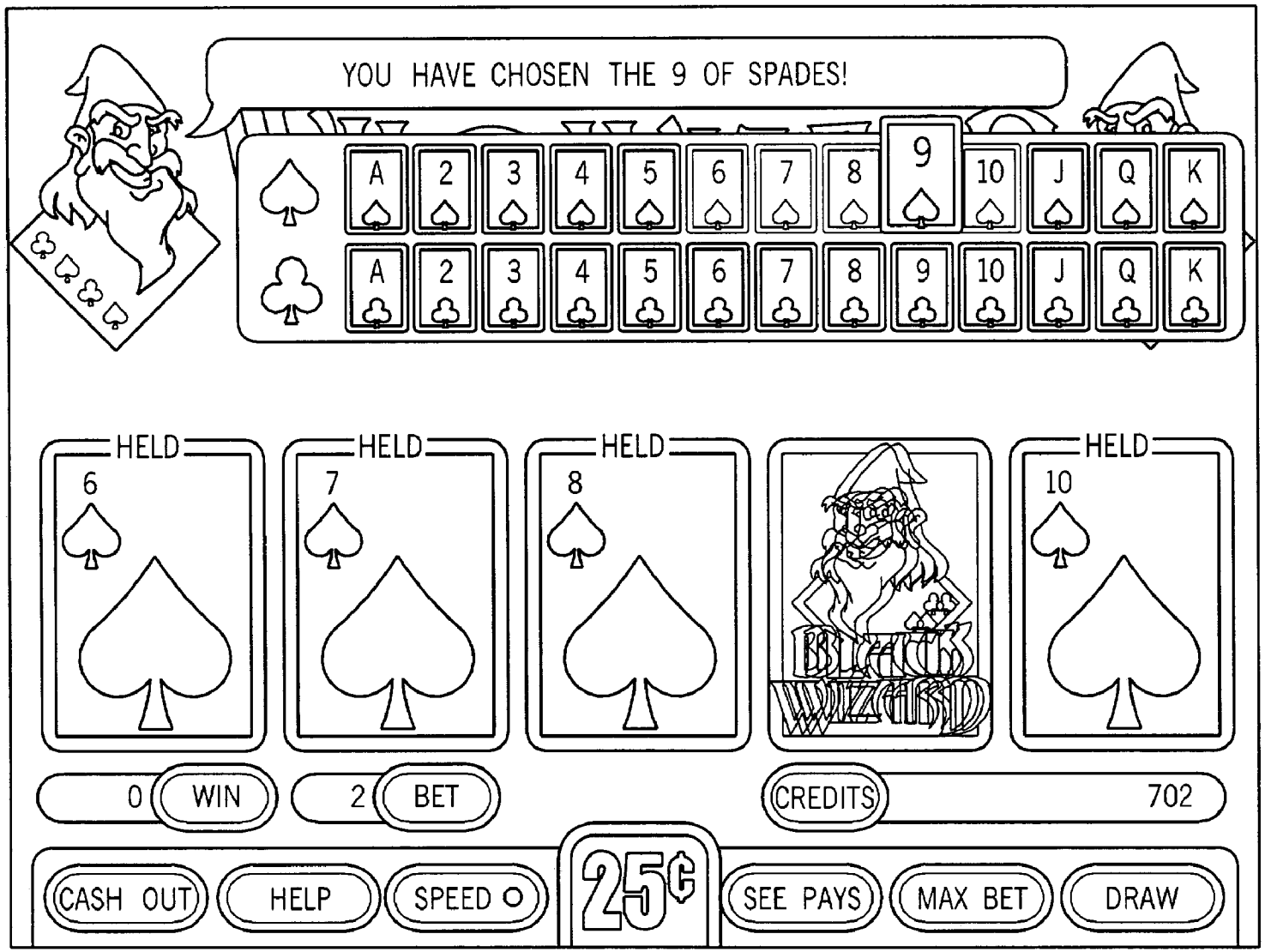
Figure 25:
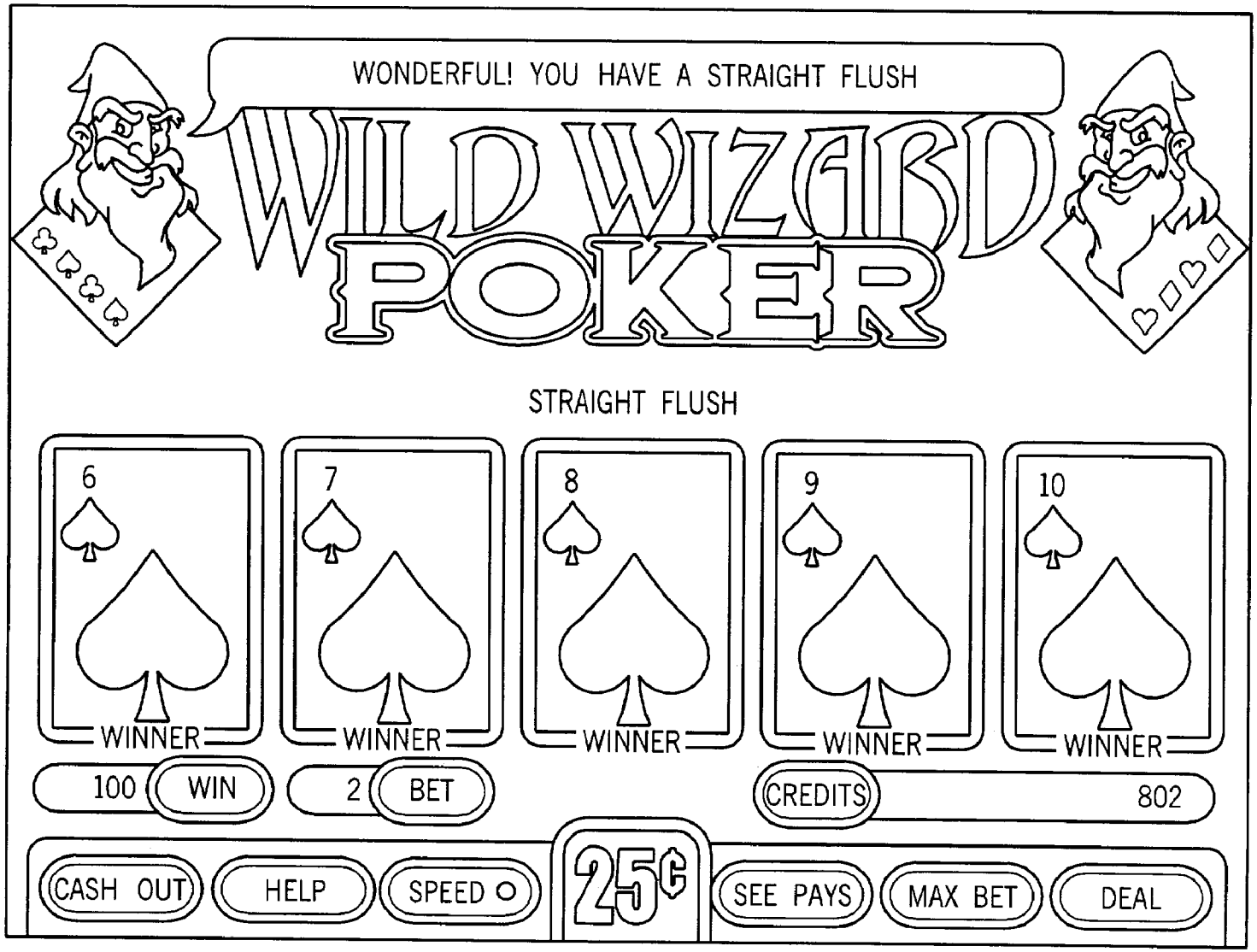

Referring to FIG. 24, the player touches 9♠ to select it, causing the "Black Wizard" card 140 to "magically" transform into the selected card. In one embodiment, the game suggests which card the player should select to most likely yield a poker hand with the highest ranking. Referring to FIG. 25, the final poker hand now includes 6♠, 7♠, 8♠, 9♠, and 10♠. The game determines the poker hand ranking of the final poker hand to be a Straight Flush. According to the pay table in FIG. 19, on a wager of 2 credits the award for a Straight Flush is 100 credits.

While the present invention has been described with reference to one or more particular embodiments, those skilled in the art will recognize that many changes may be made thereto without departing from the spirit and scope of the present invention.

For example, the special card for triggering the special feature in either the "Reel 'Em In" poker game or the "Wild Wizard" poker game may be included in other types of video poker games such as Aces and Eights poker (standard 52-card deck with premium awarded for Four of a Kind with either Aces or Eights), Aces and Faces poker (standard 52-card deck with premium awarded for Four of a Kind with either Aces or Faces), Bonus poker (standard 52-card deck with premium awarded for Four of a Kind with either Aces, Twos, Threes, or Fours), Double Bonus poker (variation of Bonus poker with premium awarded from some of the higher ranking hands), Double Bonus poker (another variation of Bonus poker with premium awarded from some of the higher ranking hands), Deuces Wild poker (standard 52-card deck with Twos wild), Joker Wild poker (standard 52-card deck plus one wild joker), Deuces and Joker Wild poker (standard 52-card deck with Twos wild plus one wild joker), 5 Card Stud poker (standard 52-card deck with no draw), etc. Each poker hand may use more than one deck of cards. The deck(s) of cards need not be replenished and shuffled prior to every poker hand.

If the "Go Fish!" card in the "Reel 'Em In" poker game triggers the "Go Fish!" feature prior to the draw, the six unselected cards in the stack 92 of seven additional cards may be treated in different ways. In a preferred embodiment discussed above, the six unselected cards are not returned to the deck until the next poker hand. In an alternative embodiment, all six unselected cards (e.g., all cards behind the "Go Fish!" card in FIG. 8 except for the selected K♦ in FIG. 9) are returned to the deck so that they can be drawn to replace any non-held cards. In another alternative embodiment, only unselected face-down cards (e.g., four face-down cards in FIG. 9) may be returned to the deck so that they can be drawn to replace any non-held cards.

The stack 92 of seven additional cards behind a "Go Fish!" card in the "Reel 'Em In" poker game may come from a different deck, such as another standard 52-card deck, so that a possible poker hand is Five of a Kind.

The stack 92 of seven additional cards behind a "Go Fish!" card in the "Reel 'Em In" poker game may initially be presented face-up instead of face-down so that the player initially knows which cards are available for selection.

In the upper portion 142 (see FIG. 23) of the main poker game screen for the "Wild Wizard" poker game, the black-suited cards for replacing a "Black Wizard" card 140, or the red-suited cards for replacing a "Red Wizard" card, may initially be randomized and presented face-down, instead of face-up, so that the player's selection is random. As in the "Reel 'Em In" poker game, the player may allowed to draw more than once from such face-down cards.

Each of these embodiments and obvious variations thereof is contemplated as falling within the spirit and scope of the claimed invention, which is set forth in the following claims.

What is claimed is:

1. A method of conducting a video poker game, comprising:

receiving a wager from a player to play the game;

dealing a plurality of face-up cards from a deck into a card hand;

if any of the face-up cards is a predefined special card, conducting a game feature that allows the player to draw a replacement card to replace the special card up to a plurality of times, the replacement card being drawn from a plurality of possible replacement cards; and determining a poker hand ranking of the card hand.

2. The method of claim 1, wherein the plurality of face-up cards includes at least five face-up cards.

3. The method of claim 1, wherein the conducting step includes initially dealing the plurality of possible replacement cards face-down and then successively displaying the replacement cards face-up until the player selects one of the replacement cards, the selected replacement card being the last replacement card displayed face-up prior to the selection.

4. The method of claim 1, further including prior to the step of determining a poker hand ranking of the card hand:

selecting, indirectly or directly, none or more of the plurality of face-up cards to be replaced; and replacing each of the selected face-up cards with a face-up card from the deck.

5. The method of claim 4, wherein the steps of selecting none or more of the plurality of face-up cards and replacing each of the selected face-up cards with a face-up card from the deck are performed prior to the step of conducting a game feature.

6. The method of claim 4, wherein the steps of selecting none or more of the plurality of face-up cards and replacing each of the selected face-up cards with a face-up card from the deck are performed after the step of conducting a game feature.

7. The method of claim 4, wherein the step of selecting none or more of the plurality of face-up cards is performed by the player.

8. The method of claim 1, wherein the deck is comprised of fifty-two standard playing cards and at least one of the predefined special card.

9. The method of claim 1, wherein the replacement card is drawn from the deck.

10. The method of claim 1, further including providing an award if the poker hand ranking meets a predetermined criterion.

11. The method of claim 1, wherein the plurality of possible replacement cards are initially presented face-down.

12. The method of claim 1, wherein the plurality of possible replacement cards are initially presented face-up.

13. The method of claim 12, wherein the special card is associated with a color and wherein the plurality of possible replacement cards include any cards remaining in the deck and having a suit of that color.

14. A method of conducting a video poker game, comprising:

receiving a wager from a player to play the game;

dealing a plurality of face-up cards from a deck into a card hand;

if any of the face-up cards is a predefined special card, conducting a game feature including:

dealing a plurality of possible face-down replacement cards from the deck, successively turning the face-down replacement cards to be face-up until a most recently turned one of the replacement cards is selected by the player, and replacing the special card in the card hand with the selected replacement card; and determining a poker hand ranking of the card hand.

15. The method of claim 14, wherein the plurality of possible replacement cards includes at least five possible replacement cards.

16. The method of claim 14, further including prior to the step of determining a poker hand ranking of the card hand:

selecting, indirectly or directly, none or more of the plurality of face-up cards to be replaced; and replacing each of the selected face-up cards with a face-up card from the deck.

17. The method of claim 16, wherein the steps of selecting none or more of the plurality of face-up cards and replacing each of the selected face-up cards with a face-up card from the deck are performed prior to the step of conducting a game feature.

18. The method of claim 16, wherein the steps of selecting none or more of the plurality of face-up cards and replacing each of the selected face-up cards with a face-up card from the deck are performed after the step of conducting a game feature.

19. The method of claim 14, further including providing an award if the poker hand ranking meets a predetermined criterion.

20. A method of conducting a video draw poker game, comprising:

receiving a wager from a player to play the game;

dealing a plurality of face-up cards from a deck into a card hand;

in response to the player selecting none or more of the plurality of face-up cards to be replaced, replacing each of the selected face-up cards with a face-up card from the deck;

if, before or after the step of replacing each of the selected face-up cards, any of the face-up cards is a predefined special card, conducting a game feature that allows the player to draw a first replacement card from the deck to replace the special card, the first replacement card being drawn from a plurality of possible replacement cards;

within the game feature, allowing the player to draw a second replacement card to replace the first replacement card if the player is not satisfied with the first replacement card, the second replacement card being drawn from the plurality of possible replacement cards; and determining a poker hand ranking of the card hand.

21. The method of claim 20, wherein the plurality of possible replacement cards are initially presented face-down.

22. The method of claim 21, wherein the conducting step allows the player to draw a replacement card, up to a plurality of times, to replace the special card.

23. The method of claim 20, wherein the plurality of possible replacement cards are initially presented face-up.

24. The method of claim 23, wherein the special card is associated with a color and wherein the plurality of possible replacement cards include any cards remaining in the deck and having a suit of that color.

25. A method of conducting a video poker game, comprising:

receiving a wager from a player to play the game;

dealing a plurality of face-up cards from a deck into a card hand;

if any of the face-up cards is a predefined special card, conducting a game feature including:

dealing a plurality of possible face-up replacement cards from the deck, the plurality of possible replacement cards including any cards remaining in the deck and associated with an attribute of the special card, selecting one of the plurality of possible replacement cards to replace the special card, and replacing the special card in the card hand with the selected replacement card; and determining a poker hand ranking of the card hand.

26. The method of claim 25, wherein the attribute is a color.

27. The method of claim 26, wherein if the color is black the plurality of possible replacement cards include any spades or clubs remaining in the deck, and wherein if the color is red the plurality of possible replacement cards include any hearts or diamonds remaining in the deck.

28. The method of claim 25, wherein the selecting step is performed by the player.

29. The method of claim 25, further including prior to the step of determining a poker hand ranking of the card hand:

selecting, indirectly or directly, none or more of the plurality of face-up cards to be replaced; and replacing each of the selected face-up cards with a face-up card from the deck.

30. The method of claim 29, wherein the steps of selecting none or more of the plurality of face-up cards and replacing each of the selected face-up cards with a face-up card from the deck are performed prior to the step of conducting a game feature.

31. The method of claim 29, wherein the steps of selecting none or more of the plurality of face-up cards and replacing each of the selected face-up cards with a face-up card from the deck are performed after the step of conducting a game feature.

32. The method of claim 25, further including providing an award if the poker hand ranking meets a predetermined criterion.

* * * * *

UNITED STATES PATENT AND TRADEMARK OFFICE

CERTIFICATE OF CORRECTION

PATENT NO. : 7,056,206 B2
APPLICATION NO. : 10/436002
DATED : June 6, 2006
INVENTOR(S) : Dion K. Aoki et al.

It is certified that error appears in the above-identified patent and that said Letters Patent is hereby corrected as shown below:

Title page, add:

--Assignee: WMS Gaming Inc., Waukegan, Illinois--

Signed and Sealed this

Sixth Day of March, 2007

JON W. DUDAS
*Director of the United States Patent and Trademark Office*